US011613973B1

(12) United States Patent
Turk et al.

(10) Patent No.: US 11,613,973 B1
(45) Date of Patent: Mar. 28, 2023

(54) DOWNHOLE GAS CONTROL VALVE HAVING BELLEVILLE WASHERS

(71) Applicant: KHOLLE Magnolia 2015, LLC, Houston, TX (US)

(72) Inventors: Stephen W. Turk, Conroe, TX (US); Michael S. Juenke, Spring, TX (US); E. Lee Colley, III, Jersey Village, TX (US)

(73) Assignee: KHOLLE Magnolia 2015, LLC, Houston, TX (US)

( * ) Notice: Subject to any disclaimer, the term of this patent is extended or adjusted under 35 U.S.C. 154(b) by 134 days.

(21) Appl. No.: 17/028,845

(22) Filed: Sep. 22, 2020

(51) Int. Cl.
*E21B 43/12* (2006.01)
*E21B 34/10* (2006.01)

(52) U.S. Cl.
CPC ..... *E21B 43/123* (2013.01); *E21B 34/10* (2013.01)

(58) Field of Classification Search
CPC ..... E21B 34/10; E21B 43/123
See application file for complete search history.

(56) References Cited

U.S. PATENT DOCUMENTS 906,733 A * 12/1908 McEvoy ..... E21B 43/123 417/112
2,519,242 A * 8/1950 Garrett ..... E21B 43/123 166/321
3,224,459 A * 12/1965 Lilly ..... E21B 43/123 137/155
3,970,144 A 7/1976 Boykin, Jr.
4,791,990 A 12/1988 Amani
5,176,164 A * 1/1993 Boyle ..... E21B 34/06 137/155
5,806,598 A 9/1998 Amani
6,021,849 A 2/2000 Averhoff
6,070,608 A 6/2000 Pringle
6,206,645 B1 3/2001 Pringle
6,691,787 B2 2/2004 Amani
6,715,550 B2 4/2004 Vinegar et al.
6,973,973 B2 12/2005 Howard et al.
(Continued)

FOREIGN PATENT DOCUMENTS

AU 763592 B2 5/2002

OTHER PUBLICATIONS

American Completion Tools, *Standing Valves and Seating Nipples*.
(Continued)

*Primary Examiner* — Umashankar Venkatesan
(74) *Attorney, Agent, or Firm* — Keith B. Willhelm

(57) ABSTRACT

A gas control valve has a valve housing, a gas flowpath, a piston, a valve seat, a valve body, an actuating chamber, and a stack of Belleville washers. The valve housing has a gas inlet, a gas outlet, and a control fluid inlet. The gas flowpath runs from the gas inlet to the gas outlet. The piston reciprocates away from and towards a normal position. The valve body is coupled to the piston and is adapted to selectively seat on the valve seat to open and shut the gas flowpath. The actuating chamber communicates with the control fluid inlet. The washer stack is under compression to bias the piston in the normal position. The piston is responsive to fluid pressure in the actuating chamber and the washer stack so that the valve may be selectively opened and closed by sequentially increasing and decreasing pressure in the actuating chamber.

12 Claims, 24 Drawing Sheets

(56) References Cited

U.S. PATENT DOCUMENTS

| | | | | |
|---|---|---|---|---|
| 9,518,674 | B2 | 12/2016 | Reed et al. | |
| 9,519,292 | B2 | 12/2016 | Thorne et al. | |
| 10,851,628 | B1 * | 12/2020 | Anderson | E21B 43/123 |
| 11,391,130 | B2 * | 7/2022 | Anderson | E21B 43/123 |

OTHER PUBLICATIONS

Peak Well Systems, *Peak Standing Valve* (© 2017 Peak Well Systems Pty Ltd.).
Petrowiki, *Gas Lift*.
Petrowiki, *Intermittent Gas Lift Plunger Application*.
R. Von Flatern, *Gas Lift*, Oilfield Review (© 2015 Schlumberger).
Schlumberger, *A- and M-Series Equalizing Standing Valves* (© 2008 Schlumberger).
Schlumberger, *Bk-B Barrier Series Injection-Pressure-Operated Gas Lift Valve* (© 2016 Schlumberger).
Schlumberger, *Cameo Single-Point Injection Orifice Gas Lift Valves* (© 2012 Schlumberger).
Schlumberger, *Injection-Pressure-Operated Gas Lift Valves* (© 2015 Schlumberger).
Schlumberger, *Nova-10-B Barrier Series Single-Point-Injection Venturi Orifice Gas Lift Valve* (© 2016 Schlumberger).
Schlumberger, *O-21R-B Single-Point-Injection Orifice Gas Lift Valve* (©2015 Schlumberger).
Schlumberger, *OM-21R-B Barrier Series Single-Point-Injection Venturi Orifice Gas Lift Valve* (© 2016 Schlumberger).
Schlumberger, *R-20-02-B Injection-Pressure-Operated Gas Lift Valve* (© 2017 Schlumberger).
Schlumberger, *Retrievable Gas Lift Valves Versatile Designs for High-Performance Applications* (© 2017 Schlumberger).
Weatherford, *RH-2 Gas-Lift Valve* (© 2013-17 Weatherford).
Weatherford, *Ultra-HP™ Wireline-Retrievable Injection-Pressure-Operated Gas-Lift Valve* (© 2016 Weatherford).
Wireline Engineering, *Product Brochure*.

* cited by examiner

DOWNHOLE GAS CONTROL VALVE HAVING BELLEVILLE WASHERS

FIELD OF THE INVENTION

The present invention relates generally to downhole valves for controlling the flow of gas through artificial lift systems and to systems for assisting production from oil and gas wells by gas injection, and especially to downhole valves and systems for injecting gas into a liquid production stream.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then are able to flow from the porous formation into the well.

In the most basic form of rotary drilling methods, a drill bit is attached to a series of pipe sections or "joints" referred to as a drill string. The drill string is suspended from a derrick and rotated by a motor in the derrick. A drilling fluid or "mud" is pumped down the drill string, through the bit, and into the bore of the well. This fluid serves to lubricate the bit. The drilling mud also carries cuttings from the drilling process back to the surface as it travels up the wellbore. As the drilling progresses downward, the drill string is extended by adding more joints of pipe.

The well will be drilled to a certain depth. Large diameter pipes, or casings, are placed in the well and cemented in place to prevent the sides of the borehole from caving in. The casing is cemented in the well by injecting a cement slurry down the casing and out the bottom of the casing. The slurry then will flow up into the well annulus, that is, the gap between the casing and the bore of the well. The cement will harden into a continuous seal throughout the annulus.

After the initial section has been drilled, cased, and cemented, drilling may proceed with a somewhat smaller wellbore. The smaller bore is lined with large, but somewhat smaller pipes or "liners." The liner is suspended from the original or "host" casing by an anchor or "hanger." A well may include a series of smaller liners, and may extend for many thousands of feet, commonly up to and over 25,000 feet.

Hydrocarbons, however, are not always able to flow easily from a formation to a well. Some subsurface formations, such as sandstone, are very porous. Hydrocarbons can flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations and especially from formations that are relatively nonporous.

Perhaps the most important stimulation technique is the combination of horizontal wellbores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation which will allow hydrocarbons to flow more easily from the formation.

Fracturing a formation is accomplished by pumping fluid, most commonly water, into the well at high pressure and flow rates. Proppants, such as grains of sand, ceramic or other particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the wellbore, creating flow paths to the well. The proppant serves to prevent fractures from closing when pumping is stopped.

Once the drilling phase is over, the well will be completed by installing equipment that will enable the formation to be fractured and allow fluids to be produced from the well in a controlled fashion. Production of natural gas is relatively easy to manage. Natural gas is predominantly methane, which is lighter than air and much lighter than liquids produced by the well. It rises naturally through the well. Other gaseous hydrocarbons, though somewhat heavier than air, are still much lighter than produced liquids and are easily, pushed up and out of the well. Liquid hydrocarbons, that is oil, is much heavier than natural gas. Ideally, however, the hydrostatic pressure of fluids within the pores of a formation, the "formation pressure," also will be sufficiently high to push oil flowing into the bottom of the well all the way to the surface.

In many wells, at least initially, that is the case. Oil will flow from the formation, into the production casing, and up through flow control equipment at the surface. Over time as production continues, however, the formation pressure will drop. If the well has been fractured, the formation will start to relax, closing many of the fractures and making it harder for fluids to flow into the well. Production of natural gas will continue, but eventually the bottom hole pressure, that is, the hydrostatic pressure urging fluids upward through the casing is no longer sufficiently high to push oil all the way to the surface. At that point, a well operator will have to resort to one or more techniques to assist in lifting oil out of the well.

Such "artificial lift" systems include the iconic "rocking horse" or walking beam system. The rocking horse is connected by a series of rods to a reciprocating pump installed down in the well. As the beam-pumping unit rocks up and down, the pump reciprocates and pumps oil to the surface through production tubing connected to the pump outlet. Other systems use surface motors and connecting rods that are rotated to turn a downhole progressive cavity pump. Such surface-driven artificial lift systems have advantages. Surface motors often are cheaper and always are more accessible for service. Connecting rods, however, can fatigue and fail and can damage tubing. It also may be difficult or impractical to install connecting rods through very deep or long deviated wells. Mechanical pumps also tend to wear, especially when there are relatively high concentrations of solid particles in the production fluids.

Other artificial lift systems utilize an electric motor that is installed in the well and connected to a downhole pump. It may be a reciprocating or progressive cavity pump, but more commonly the downhole pump is an electric submersible pump ("ESP"). Electric power is supplied to the motor by a cable running from the surface. Electric motors, however, can overheat in the elevated temperatures common at the bottom of oil and gas wells. Gas and solids in production fluids can diminish the performance or damage pumps, especially electric submersible pumps. Maintaining downhole motors and pumps also is more difficult and time consuming.

"Gas lift" is another common form of artificial lift. Gas lift systems—in one fashion or another—use natural gas to assist in moving oil to the surface. As compared to other systems for artificial lift, they tend to be more flexible and trouble free. Gas lift systems do not incorporate downhole motors or mechanical pumps, and instead are controlled and operated by valves. Surface equipment, such as field compressors, also can be shared among several wells. Moreover, gas lift systems can accommodate a wide range of production rates. Different gas lift techniques such as continuous gas lift, intermittent gas lift, plunger-assisted lift, and gas pumps—may be employed over the life of a well as production is depleted.

For example, once the formation pressure is no longer high enough to push oil all the way to the surface, operators can employ "continuous" gas lift, A smaller diameter pipe or "production tubing" is installed in the casing to convey oil to the surface. Natural gas, typically a portion of the natural gas produced by the well, then is pumped into the annulus between the production tubing and the casing. Gas flows through a valve into the production tubing. The injected gas "lightens" the column of oil in the tubing. That is, the oil will be infused with gas, reducing its density and reducing the hydrostatic pressure of fluid in the tubing below that of the formation pressure. Liquids will again be able to flow to the surface.

After a period of time, the well will be depleted further, and the formation pressure will drop to a level at which it is no longer practical to lift oil by continuous gas injection. An operator then may switch to an "intermittent" gas lift system. Intermittent gas lift systems are similar to continuous lift systems. Instead of injecting gas continuously into the oil, however, large volumes of gas are injected periodically into the production tubing. The goal is to produce a large bubble of gas that will lift the oil above it to the surface.

Liquid, however, has a natural tendency to flow around or through a gas bubble, even when confined in a relatively small tube. That "fall back" of oil through the gas bubble can significantly impair the efficiency of intermittent gas lift, especially for thinner, less viscous oil. As much as 10% of the initial slug of oil may fall back through the gas for every 1,000 feet of lift. In the face of such inefficiencies, operators may turn to "plunger-assisted" lift or gas pump systems.

Plunger-assisted lift is similar to intermittent gas lift. Gas is injected periodically, but the gas flows under a plunger carried within the production tubing instead of into the tubing itself. Gas accumulates under the plunger and, buoyed by the gas, the plunger travels to the surface pushing oil ahead of it. The plunger fits closely within the production tubing and prevents oil from flowing down around it. Once at the surface, gas beneath the plunger is vented, and the plunger sinks back down the production tubing to repeat the cycle.

When intermittent or plunger-assisted lift are no longer practical, operators can employ gas pump systems. Gas pumps typically incorporate a vessel or tank that provides a chamber. Thus, they also are referred to as chamber lift systems. The tank is installed in the bottom of the well where oil can still collect. The production tubing leads into a "dip tube" that extends into the tank. A check valve allows oil to flow into, but not out of the lower end of the tank. A check valve in the dip tube allows oil to flow up and out of the dip tube, but checks back-flow from the production tubing. The tank is allowed to fill with oil from the bottom of the well. Gas then is injected into the top of the tank, pushing oil up the dip tube, out of the tank, and into the production tubing. Once the tank has been emptied, gas is vented from the tank to allow oil to fill the tank again. The process is repeated, effectively pumping the oil to the surface in slugs.

Some or all of those gas lift techniques may be used over the life of a well. They offer distinctly different capabilities while presenting different installation and maintenance issues. Cumulatively, they may greatly extend the period of time over which production from the well is economically feasible. Continuous gas injection, however, is almost universally the first part of any plan for producing a well with gas lift.

Ideally, gas will be injected deep in the production string as close as practical to the bottom of the well. With a valve thus located, the entire stream of liquid flowing up the production tube may be lightened by injected gas. When a continuous lift system is installed, however, liquid initially fills both the production tubing and the annulus. Liquids in the annulus must be displaced or "unloaded" by pumping gas into the annulus. As gas is pumped into the annulus, liquid flows through the valve into and up the production stream. In many cases, especially for deeper wells, it may not be possible to provide gas at sufficient pressures to push liquid out of the annulus to a level near the bottom where gas can be injected most effectively. Gas supply may be limited, or the fluids in the production tubing may be particularly dense. The cost of compressing the gas may be too high. The compressor may not have sufficient power. If it does, it may have a capacity that is far greater than that required once the annulus has been unloaded.

Thus, most conventional continuous gas injection systems employ a series of valves installed on the production tubing at progressively increasing depth. The valves are designed to allow gas pumped into the annulus between the production string and the casing to flow into the production string. The upper injection valves are often referred to as unloading valves. As described further below, they assist in unloading liquid from the annulus. The bottom injection valve is often referred to as the operating valve, as ultimately it will be the only valve injecting gas if the system operates as intended.

Most gas injection valves are actuated by injection pressure. That is, they are actuated by the pressure of the gas in the annulus that will be injected into the production stream and perform the work of lifting liquids to the surface. Gas enters the valve through an inlet that communicates with the annulus. A valve seat is provided in a flow path between the valve inlet and an outlet. A valve body is biased onto the valve seat so that the valve is normally closed. As gas pressure in the annulus increases, it eventually overcomes the biasing force on the valve body. The valve body is lifted off the valve seat, opening the valve and allowing gas to flow into the production string.

The most common design for gas injection valves uses a pressure-responsive bellows to apply a biasing force to the valve body. The bellows is exposed to pressure in a sealed pressure chamber within the valve housing and, via the gas inlet, to pressure in the annulus. The pressure chamber is charged with a gas, typically nitrogen, to provide a predetermined actuating pressure. As pressure in the annulus varies, the bellows will expand and contract accordingly. The valve body is coupled to the bellows. Thus, the valve body will be seated, and the valve closed unless and until pressure in the annulus exceeds the valve actuating pressure.

Unloading the annulus is commenced by pumping gas at controlled rates and pressures into the annulus. The valves are normally closed, but pressure in the annulus, that is, the "casing" pressure will increase rapidly to a point where all of the valves along the production tubing are open. As gas continues to be carefully metered into the annulus, it pushes liquid down the annulus, through the injection valves, and up the production tubing. Casing pressure increases, reaching a peak or "kickoff" pressure just prior to the liquid level reaching the uppermost unloading gas injection valve.

Once the liquid level drops below the uppermost valve, gas flows through the valve into the production tubing. The injected gas lightens the column of oil in the tubing, reducing its hydrostatic head and causing a corresponding drop in the casing pressure.

As the operation continues, the liquid level reaches and drops below the next lower unloading injection valve. Gas starts to flow through the lower valve, causing another reduction in casing pressure. The pressure drop causes the uppermost unloading valve to shut, That progression is repeated as pumping continues and the liquid level in the annulus drops. Gas will flow through progressively lower unloading valves, the casing pressure will drop in steps, and upper unloading valves will close in sequence until the lowermost, operating injection valve is the only valve left open.

While valves actuated by injection pressure have been widely used in continuous gas lift systems, those systems present significant challenges that may not always be overcome. Perhaps most significantly, the system and each injection valve must be carefully designed in order to ensure that the well is unloaded, and that gas ultimately is injected through the lowermost, operating valve. The operating valve, and each unloading valve in the series must be tuned and calibrated precisely according to the injection station at which it will be installed. Most importantly, they must be tuned to the depth of the injection station at which they will be installed. Well temperature, production fluid density, formation pressure, and other well conditions at each station must be factored in. Moreover, the tuning of each injection valve must be coordinated with that of the other valves in the system.

In particular, the biasing force against the valve body must be tuned to each station. In bellows-type valves, for example, each unloading valve in the system will require a different pressure charge so that it shuts at the appropriate time as the annulus is being unloaded. The lowermost, operating valve must be tuned to stay open once the annulus is unloaded. The size of the valve orifice also may need adjustment from station to station. It will be coordinated with the anticipated rate and pressure at which gas will be pumped into the annulus to ensure that the proper amount of gas is injected at each station. Sufficient gas must be injected to generate at least the minimum or critical gas velocity in the production tubing that is required to move liquid droplets upward. In short, conventional continuous gas lift systems are unique to each well. Their design is a complex, time consuming process that must be followed up with intricate manufacturing, assembly, and quality control efforts.

Systems using conventional injection-pressure actuated gas injection valves also face significant challenges as the depth of the well increases and more valves are installed. Since it drops incrementally as each unloading valve shuts, the casing pressure may be significantly diminished by the time the last unloading valve shuts. That diminution of casing pressure may limit the amount of gas that can be injected through the operating valve and the depth at which it may be installed for optimal gas injection. In either event, well production can be diminished.

Moreover, once the annulus is unloaded, gas should be injected only through the lowermost, operating valve. The unloading valves higher up on the production tubing should not reopen. Conditions in a well, however, are not static. Casing pressure can change significantly over time and can cause upper, unloading valves to reopen. Gas then will be injected higher up in the production tubing where it is less effective in reducing the hydrostatic head in the tubing.

Finally, bellows-type injection valves become more problematic as they are installed in deeper wells. The gas charge in the pressure chamber necessarily increases as the valve is designed for greater depths. Managing the effects of that pressure on the bellows is more challenging. Despite recent advances, the bellows are more stressed as pressure in the chamber increases and are more susceptible to failure, especially if there are any manufacturing defects.

The statements in this section are intended to provide background information related to the invention disclosed and claimed herein. Such information may or may not constitute prior art. It will be appreciated from the foregoing, however, that there remains a need for new and improved gas lift systems to enhance production from oil and gas wells. Such disadvantages and others inherent in the prior art are addressed by various aspects and embodiments of the subject invention.

SUMMARY OF THE INVENTION

The subject invention relates generally to downhole valves for injecting gas into liquid production streams in oil and gas wells and other downhole gas control valves, to systems for assisting production from oil and gas wells by gas injection, and to pocket mandrels in which such valves may be installed. It encompasses various embodiments and aspects, some of which are specifically described and illustrated herein. One broad embodiment of the invention provides for a downhole valve for controlling flow of gas through a gas lift system for producing liquids from an oil and gas well. The downhole gas control valve comprises a valve housing, a gas flowpath, a piston, a valve seat, a valve body, an actuating chamber, and a stack of Belleville washers. The valve housing has a gas inlet, a gas outlet, and a control fluid inlet. The gas flowpath runs from the gas inlet to the gas outlet. The piston is mounted for reciprocating movement within the housing away from and towards a normal position. The valve seat is in the gas flowpath. The valve body is coupled to the piston and adapted to selectively seat on the valve seat to open and shut the gas flowpath. The actuating chamber communicates with the control fluid inlet and is isolated from the gas flowpath. The stack of Belleville washers is under compression to bias the piston in the normal position and resist movement of the piston away from the normal position. The piston thus is responsive to fluid pressure in the actuating chamber and the washer stack such that the valve body may be selectively seated on the valve seat by sequentially increasing and decreasing pressure in the actuating chamber relative to the biasing force of the washer stack.

Other embodiments provide such downhole gas control valves where the valve housing has a generally elongated, cylindrical shape and the piston and the valve body are aligned and reciprocate along the primary axis of the valve housing.

Still other embodiments provide such downhole gas control valves where the valve body is coupled to the piston by a valve stem.

Additional embodiments provide such downhole gas control valves where the valve stem extends between the piston and the valve body along the path of the piston reciprocating movement.

Yet other embodiments provide such downhole gas control valves where the valve body is seated on the valve seat and the valve is shut when the piston is in its the normal position. The valve is adapted to open when fluid pressure in the actuating chamber is increased above an actuation pressure exceeding the biasing force of the washer stack and to close when fluid pressure in the actuating chamber is decreased below the actuation pressure.

Further embodiments provide such downhole gas control valves where the valve body is not seated on the valve seat and the valve is open when the piston is in its the normal position. The valve is adapted to close when fluid pressure in the actuating chamber is increased above an actuation pressure exceeding the biasing force of the washer stack and to open when fluid pressure in the actuating chamber is decreased below the actuation pressure.

Other embodiments provide a gas lift system for producing liquids from a well. The system comprises the novel downhole gas control valves. Still other embodiments provide methods of producing liquids from a welt. The method comprises operating the novel gas lift systems.

Yet other embodiments provide a gas pump system for producing liquids from a well. The gas pump system comprises the novel downhole gas control valves. Other embodiments provide a method of producing liquids from a well. The method comprises operating the novel gas pump systems.

In other aspects and embodiments, the subject invention provides gas lift systems for producing liquids from a well. The gas lift system comprises production tubing, a plurality of gas injection valves, and a single fluid control line. The production tubing is adapted to convey fluid from the welt to the surface. The gas injection valves are installed on the production tubing and adapted to control the flow of gas between an annulus surrounding the production tubing and the production tubing. The control line communicates with each of the plurality of gas injection valves. The gas injection valves comprise a valve housing, a gas flowpath, a valve seat, a valve body, a resilient element, and an actuating chamber. The valve housing has a gas inlet communicating with one of either the annulus or the production tubing, a gas outlet communicating with the other of the annulus or the production tubing, and a control fluid inlet communicating with the control line. The gas flowpath runs from the gas inlet to the gas outlet. The valve seat is in the gas flowpath. The valve body is adapted to selectively seat on the valve seat to open and shut the gas flowpath. The resilient element biases the valve body on the valve seat such that the valve is normally shut. The actuating chamber communicates with the control fluid inlet and is isolated from the gas flowpath. The resilient element is responsive to fluid pressure introduced into the actuation chamber through the control line such that the valve body may be selectively seated on the valve seat by sequentially increasing and decreasing pressure in the actuating chamber relative to the biasing force of the resilient element.

Other embodiments provide such gas lift systems where the gas inlet communicates with the annulus and plurality of gas injection valves are and adapted to inject gas from the annulus into the production tubing.

Still other embodiments provide such gas lift systems where the gas inlet communicates with the production tubing and the plurality of gas injection valves are adapted to inject gas from the production tubing into the annulus.

Additional embodiments provide such gas lift systems where the resilient element is a piston coupled to a stack of Belleville washers or where it is a gas-charged, pressure-responsive bellows.

Yet other embodiments provide such gas lift systems where the control line runs outside of the production tubing in the annulus.

Further embodiments provide such gas lift systems where the gas injection valve is actuatable by hydraulic pressure and the control line is a hydraulic control line or a gas-over-hydraulic control line or where the gas injection valve is actuatable by pneumatic pressure and the control line is a pneumatic control line.

Other embodiments provide such gas lift systems where the gas injection valves are replaceable through the production tubing or where the gas injection valves are mounted in pockets in the production tubing.

Still other embodiments provide such gas lift systems where the system comprises a plurality of internal receptacles provided in an internal pocket in the production tubing. The gas injection valves are installed in the receptacles. The internal receptacles have a port communicating with the annulus and a port communicating with the control line. The gas injection valves comprise seals defining a first chamber communicating with the annulus port and the valve housing gas inlet and seals defining a second chamber communicating with the control line and the control fluid inlet.

Additional embodiments provide such gas lift systems where the system comprises a plurality of internal receptacles provided in an internal pocket in the production tubing. The gas injection valves are installed in the receptacles. The internal receptacles have a port communicating with the annulus and a port communicating with the control line. The gas injection valves comprise seals defining a first chamber communicating with the annulus port and the valve housing gas outlet and seals defining a second chamber communicating with the control line and the control fluid inlet.

Further embodiments provide such gas lift systems where the system comprises a downhole shut-off valve in the control line upstream of the shallowest of the plurality of ns gas injection valves or where the downhole control line shut-off valve is installed in an internal receptacle provided in an internal pocket in the production tubing.

Other embodiments provide such gas lift systems where the system comprises a conduit communicating with the control line and the control fluid inlet of the gas injection valve and a poppet valve. The poppet valve is mounted in the conduit and controls flow of control fluid through the conduit. The poppet valve comprises a valve seat in the conduit and a valve body adapted to selectively seat on the valve seat to open and shut the conduit. A resilient element applies force to the valve body to bias the valve body on the valve seat and normally shut the conduit. A valve stem is coupled to the valve body. The valve stem has a camming surface extending through the conduit and is adapted to engage a camming surface on the gas injection valve. The engagement of the camming surfaces causes the valve stem to move against the resilient element and away from the valve seat to open the conduit.

Still other embodiments provide such gas lift systems where the conduit in which the poppet valve is mounted is a port in a wall of an internal receptacle provided in an internal pocket in the production tubing.

In other aspects and embodiments, the subject invention provides for pocket mandrels adapted for assembly into production tubing in an oil and gas well. The pocket mandrel comprises a receptacle having a port. The receptacle is adapted to receive a valve that has a camming surface. The port extends through a wall of the receptacle and conducts fluid from a fluid control line into the receptacle. A poppet valve is mounted in the port. The poppet valve comprises a valve seat in the port and a valve body adapted to selectively seat on the valve seat to open and shut the port. A resilient element applies force to the valve body to bias the valve body on the valve seat and normally shut the port. A valve stem is coupled to the valve body. The valve stem has a camming surface extending from the port into the interior of the receptacle and is adapted to engage the camming surface on the gas injection valve. The engagement of the camming surfaces causes the valve stem to move against the resilient element and away from the valve seat to open the port.

Other embodiments provide such gas lift systems comprising a gas control valve is installed in the novel pocket mandrels. The gas control valve is actuated by fluid in the control line.

Finally, still other aspects and embodiments of the invention will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the way it may be practiced. The subject invention encompasses other embodiments consistent with the claims set forth herein.

BRIEF DESCRIPTION OF THE DRAWINGS

FIG. 2A (prior art) is a schematic illustration of well 1 having a casing assembly 20 after completion of a plug and perf operation.

FIG. 2B (prior art) is a schematic illustration of well being produced through casing 20.

FIG. 2C is a schematic illustration of well 1 after components of a first embodiment 30 of the novel gas injection systems have been installed in casing 20.

FIG. 20 is a schematic illustration showing production system 30 being used to produce oil from well 1 by continuous gas lift.

FIG. 2E is a schematic illustration showing production system 30 being used to produce oil from well 1 by intermittent gas lift.

Figure 1:
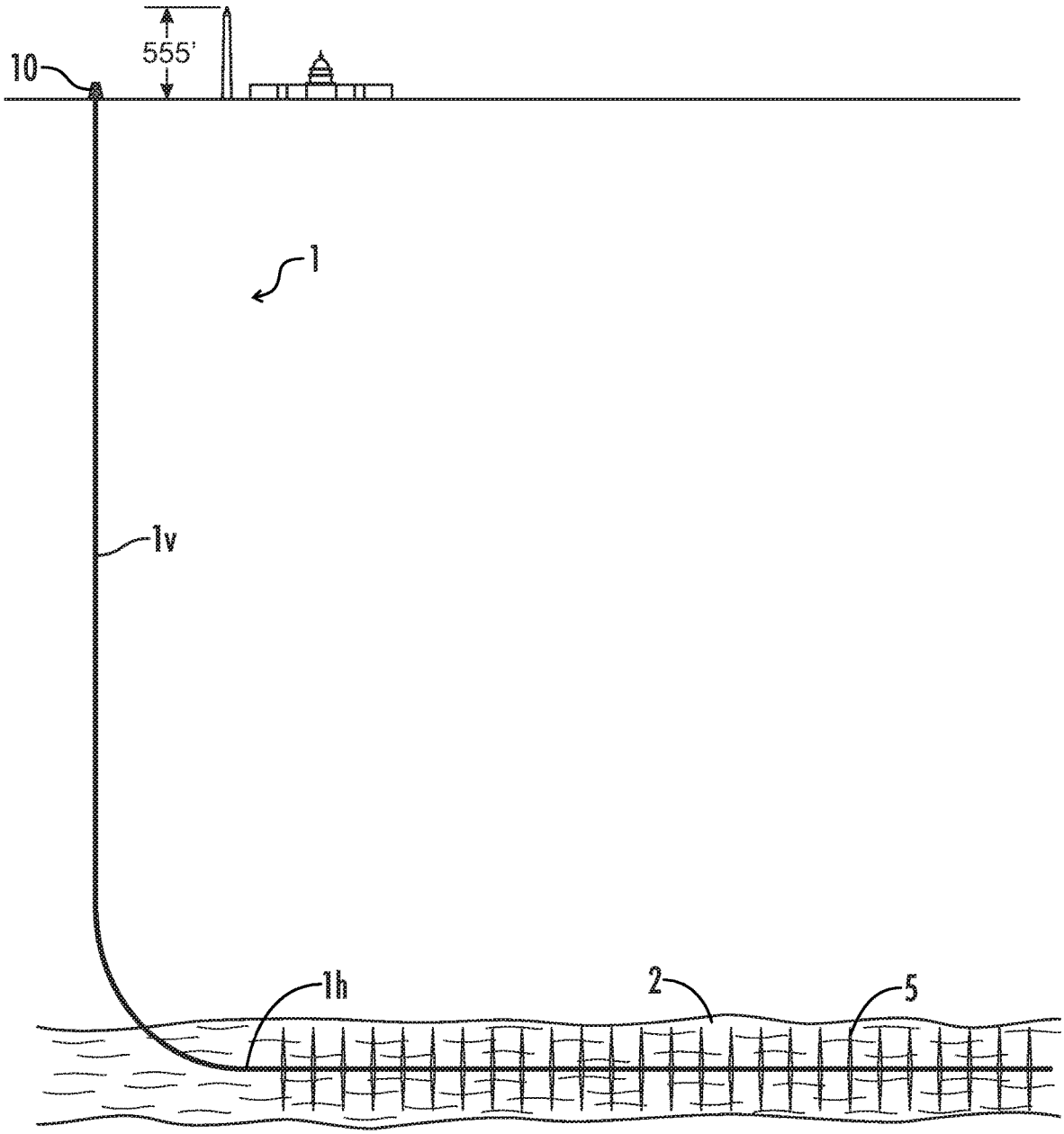
FIG. 1 (prior art) is a schematic depiction in approximate scale of an oil and gas well 1 having a horizontal extension 1*h*.

In the drawings and description that follows, like parts are identified by the same reference numerals. The drawing figures are not necessarily to scale. Certain features of the embodiments may be shown exaggerated in scale or in somewhat schematic form and some details of conventional design and construction may not be shown in the interest of clarity and conciseness.

DESCRIPTION OF ILLUSTRATIVE EMBODIMENTS

The subject invention relates generally to downhole gas control valves and gas lift systems for enhancing the flow of oil and other liquids from wells. Some of those embodiments are described in detail herein. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

The terms "upper" and "lower" and "uphole" and "downhole" as used herein to describe location or orientation are relative to the well. Thus, "upper" and "uphole" refers to a location or orientation toward the upper or surface end of the well. "Lower" or "downhole" is relative to the lower end or bottom of the well. It also will be appreciated that the course of the wellbore may not necessarily be as depicted schematically in FIG. 1. Depending on the location and orientation of the hydrocarbon bearing formation to be accessed, the course of the wellbore may be more or less deviated in any number of directions.

"Axial," "radial," "angularly," and forms thereof reference the central axis of the well and tools. For example, axial movement or position refers to movement or position generally along or parallel to the central axis. "Lateral" movement and the like also generally refer to up and down movement or positions up and down. "Radial" will refer to positions or movement toward or away from the central axis.

Overview of Well Completion Operations

The complexity and challenges of completing and producing a well perhaps may be appreciated by reference to FIG. 1. FIG. 1 shows a well 1 approximately to scale. Well 1 includes a vertical portion iv and a horizontal portion 1*h*. Schematic representations of the Washington Monument, which is 555 feet tall, and the Capital Building are shown next to a derrick 10 to provide perspective. Well 1 has a vertical depth of approximately 6,000 feet and a horizontal reach of approximately 6,000 feet. Such wells are typical of wells in the Permian Basin. Deeper and longer wells, however, are constructed both in the Permian and elsewhere. While neither the vertical portion iv or the horizontal portion 1*b* of well 1 necessarily run true to vertical or horizontal, FIG. 1 provides a general sense of what is involved in oil and gas production. Well 1 is targeting a relatively narrow hydrocarbon-bearing formation 2, and all downhole equipment must be installed and operated far away from the surface.

FIG. 2 show well 1 schematically in greater detail and in various stages of completion and production. In FIG. 2A, a well bore 3 has been drilled through formation 2 and a production casing 20 has been sealed within well bore 3 with a sheath of cement 4. Casing 20 includes various tools, including a toe valve 21 and a float assembly 22. Float assembly 22 includes various tools that are commonly used to assist in running casing 20 into well 1 and cementing it in bore 3.

Figure 2A:
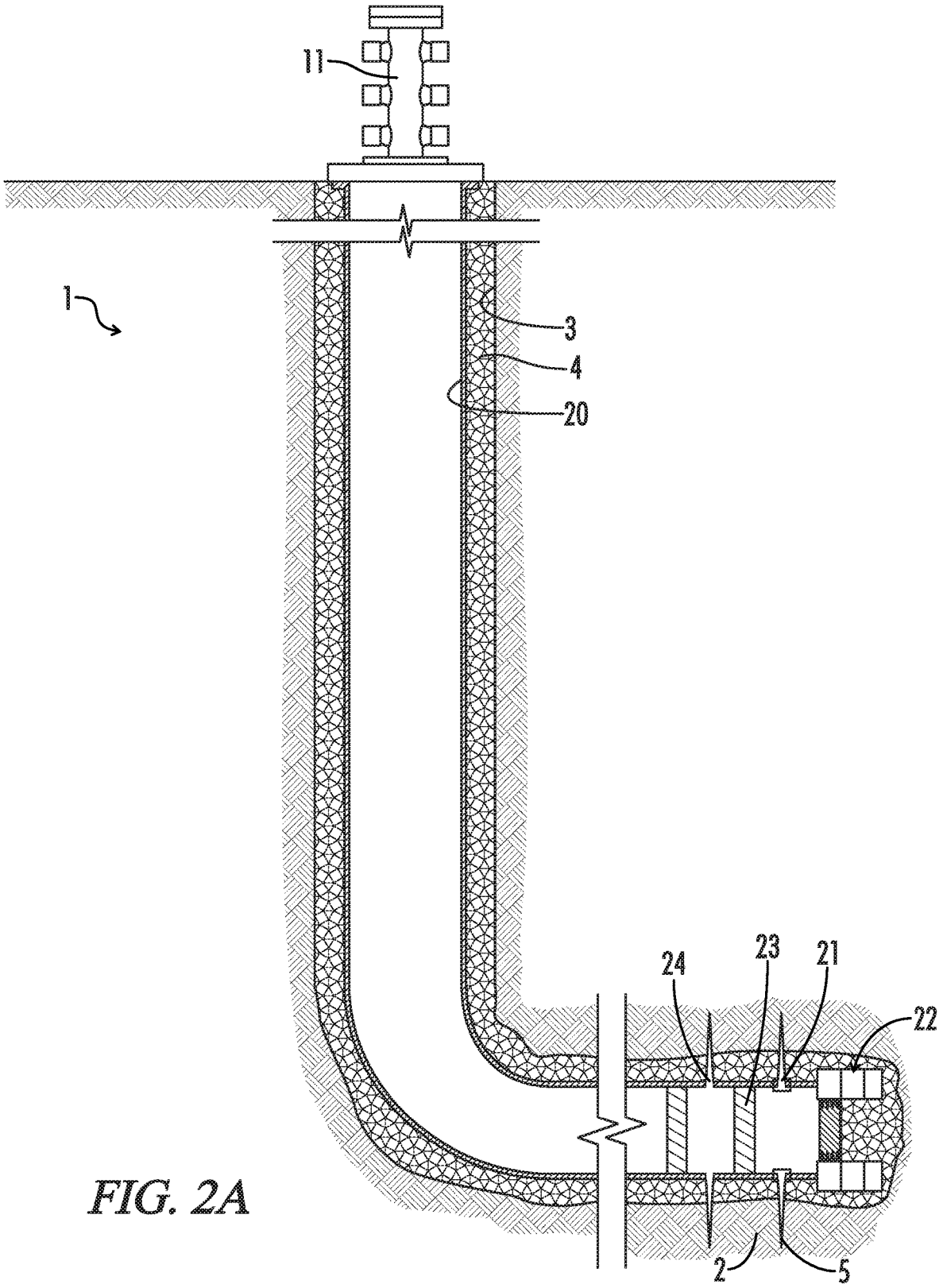
FIGS. 2A to 2E ("FIGS. 2") are sequential schematic representations showing a well 1 being readied for production or "completed" and various stages of production.

Well 1 is shown in FIG. 2A immediately after completion of a "plug and perf" job. Toe valve 21 was opened and fluid pumped into formation 2 at high pressure and flow rates to create fractures 5 in a first zone near the "toe" of well 1. A first plug 23 was installed above toe valve 21, and first perforations 24 were creating in casing 20 above plug 23. Fluid then was pumped into casing 20 to fracture formation 2 in a second zone near perforations 24. Another plug 23 then was installed above the first plug 23, perforations 24 were formed above the second plug 23, and formation 2 was fractured in a third zone. That process was repeated until fractures were created along the length of horizontal extension 1*h* as shown in FIG. 1.

Figure 2B:
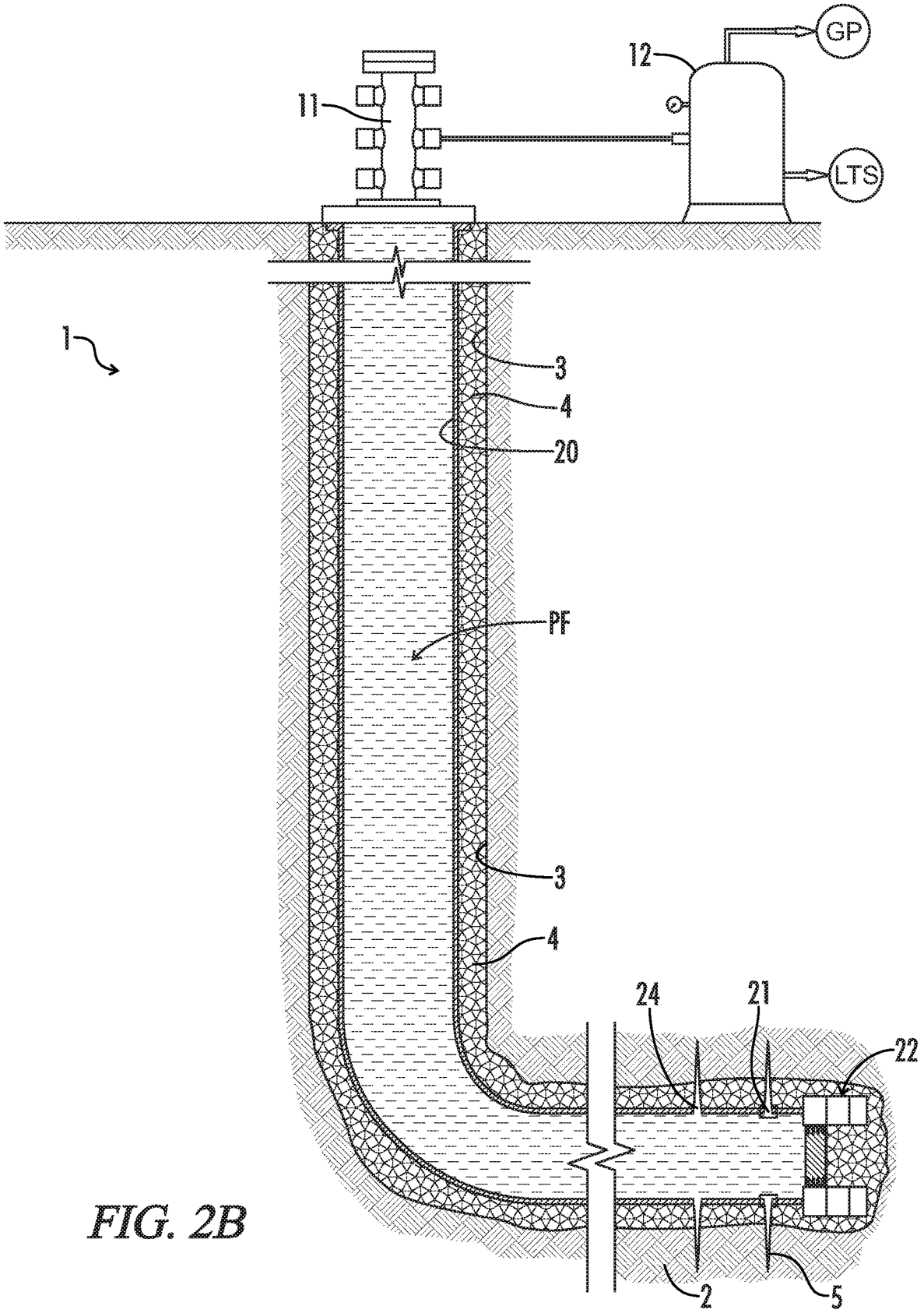

FIG. 2B shows well 1 during the initial stages of production. Frac plugs 23 have been removed from casing 20, typically by drilling them out. Production fluids PF, which in this example are predominantly oil, a liquid, are flowing up casing 20 in response to hydrostatic pressure in formation 2. Flow of production fluids PF out of casing 20 is controlled by well head 11. Well head 11 diverts production fluids PF into an oil-gas separator 12. Separator 12, as its name implies, separates the liquid and gas components of the production stream. Gas is diverted into a gas pipeline GP, while liquids are diverted into a liquid transportation system LTS.

It will be appreciated that both the subsurface and surface systems have been greatly simplified. A production casing, for example, may incorporate many different tools to assist in installing and cementing the casing. Moreover, solid particulates typically are entrained with the oil and other liquids produced from the well, especially in the initial production stream. Liquid typically will be diverted from an oil-gas separator into a sand separator. Produced oil may be transferred to a storage tank for transport to a pipeline, or it may feed directly into a pipeline. Gas streams may be run through dryers and filters designed to remove moisture and particulates that can corrode gas pipelines.

Figure 2C:
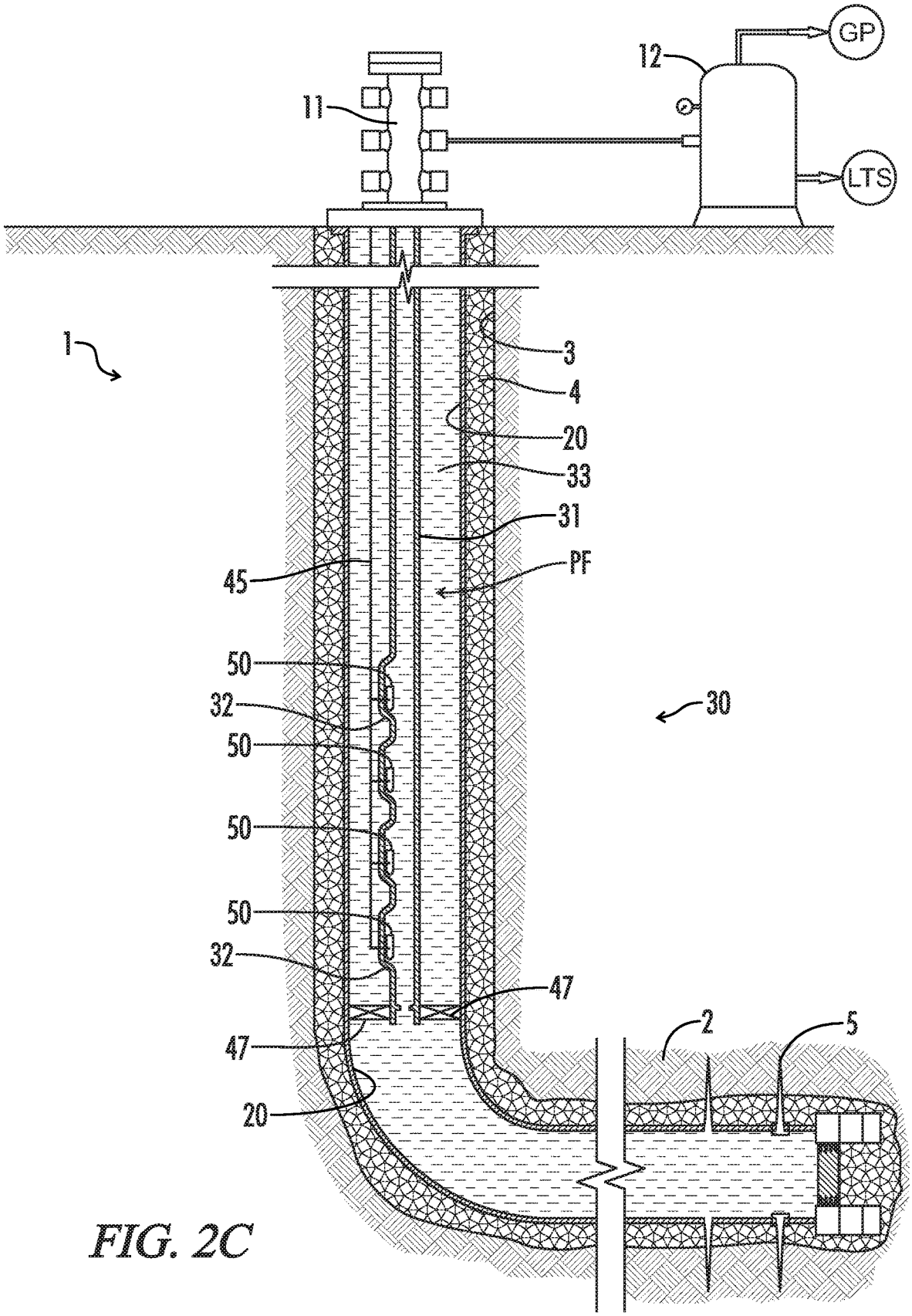
Figure 2D:
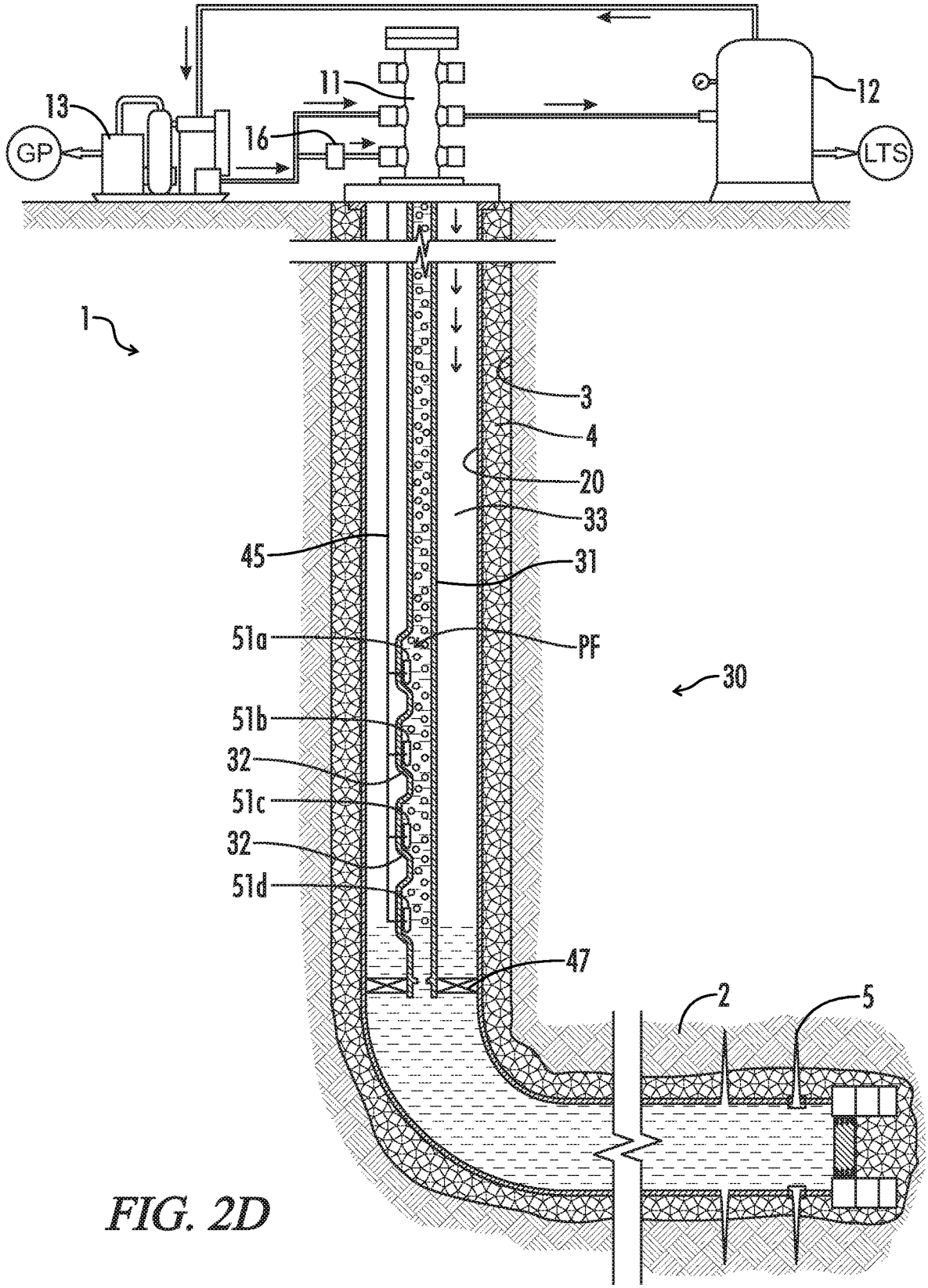
Figure 2E:
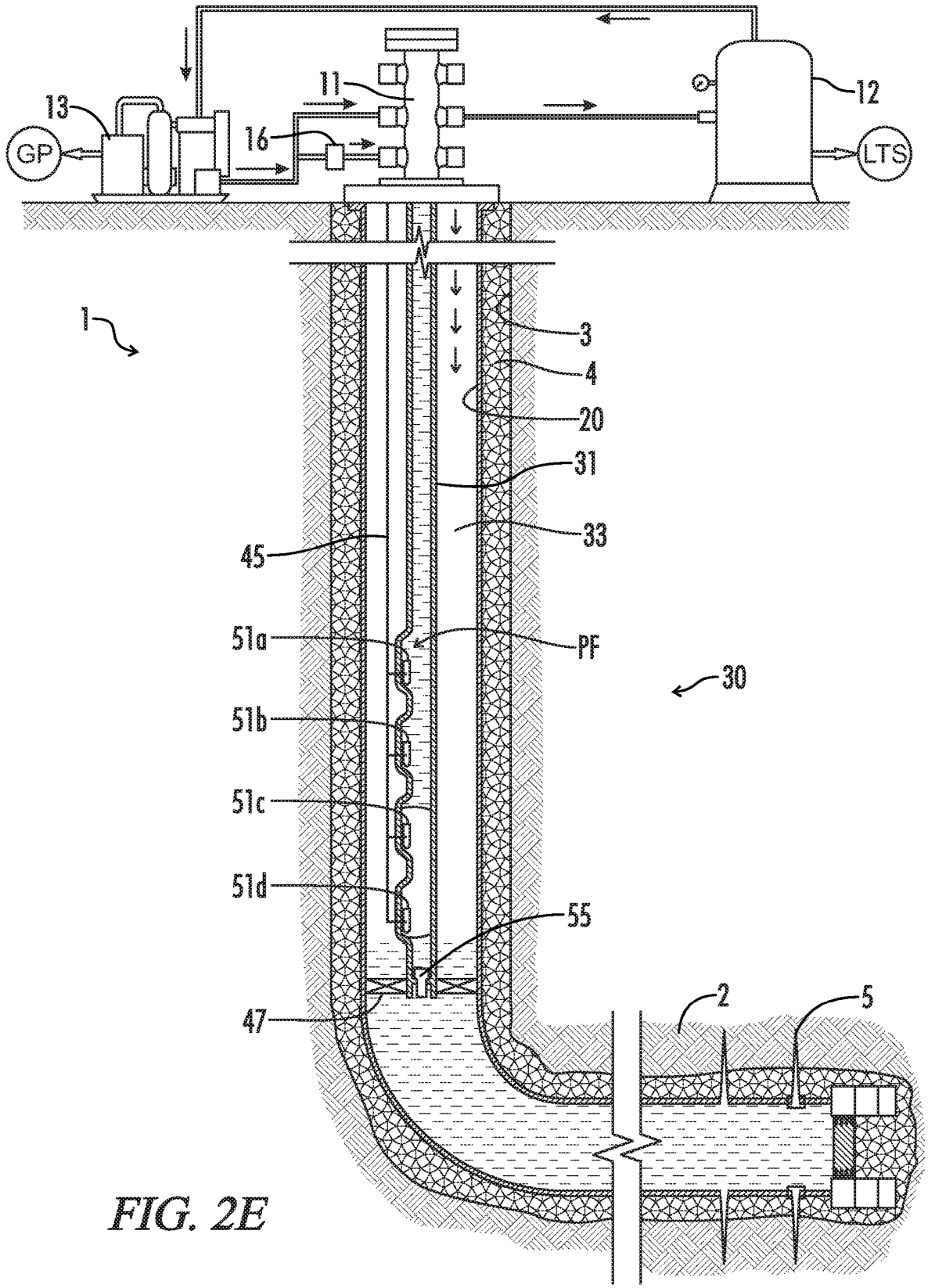
Figure 3:
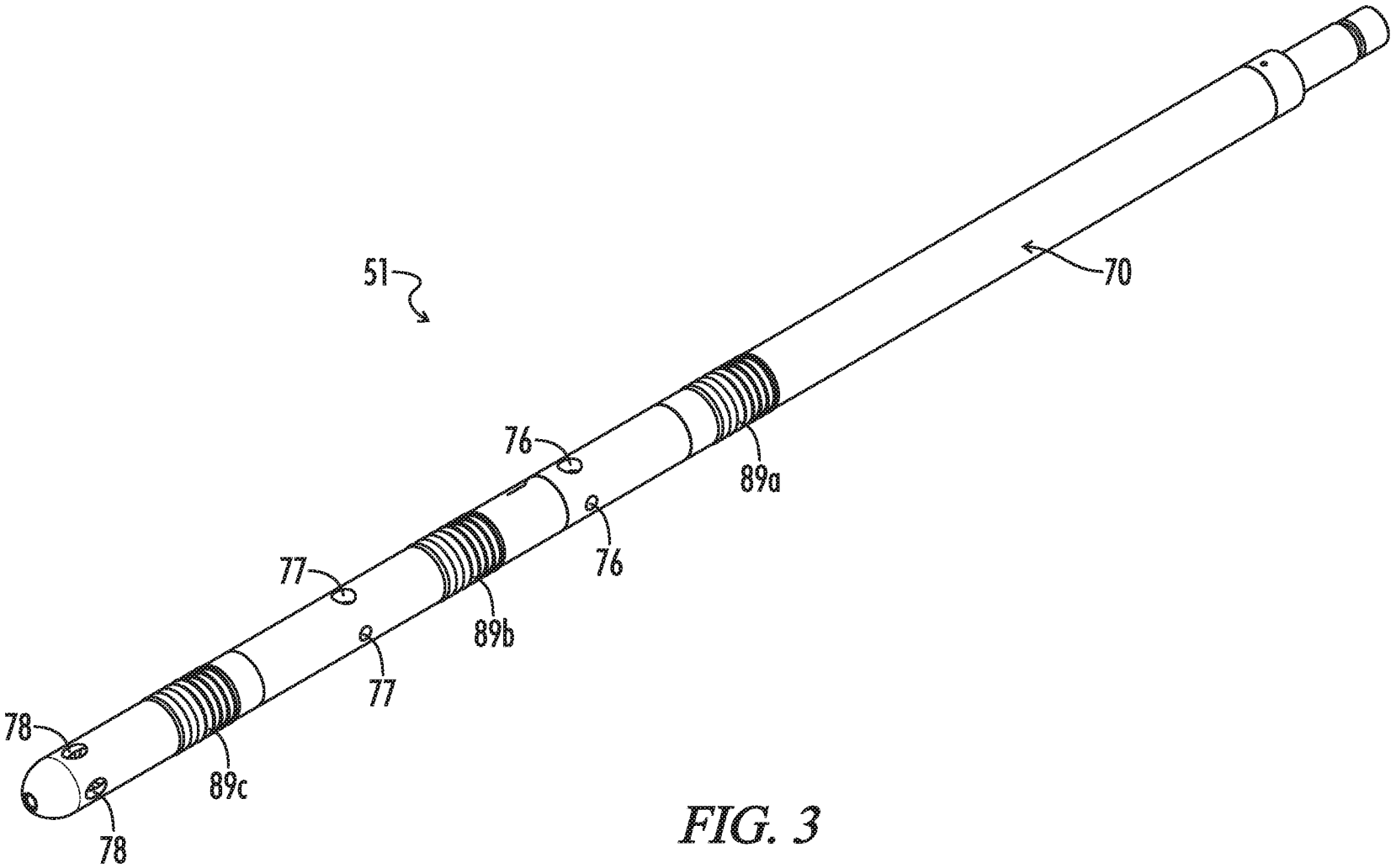
FIG. 3 is an isometric view of a first preferred embodiment 51 of the novel downhole gas control valves of the subject invention which is used to inject gas into a production tube 31 of production system 30 as shown schematically in FIGS. 2D and 2E.
Figure 4:
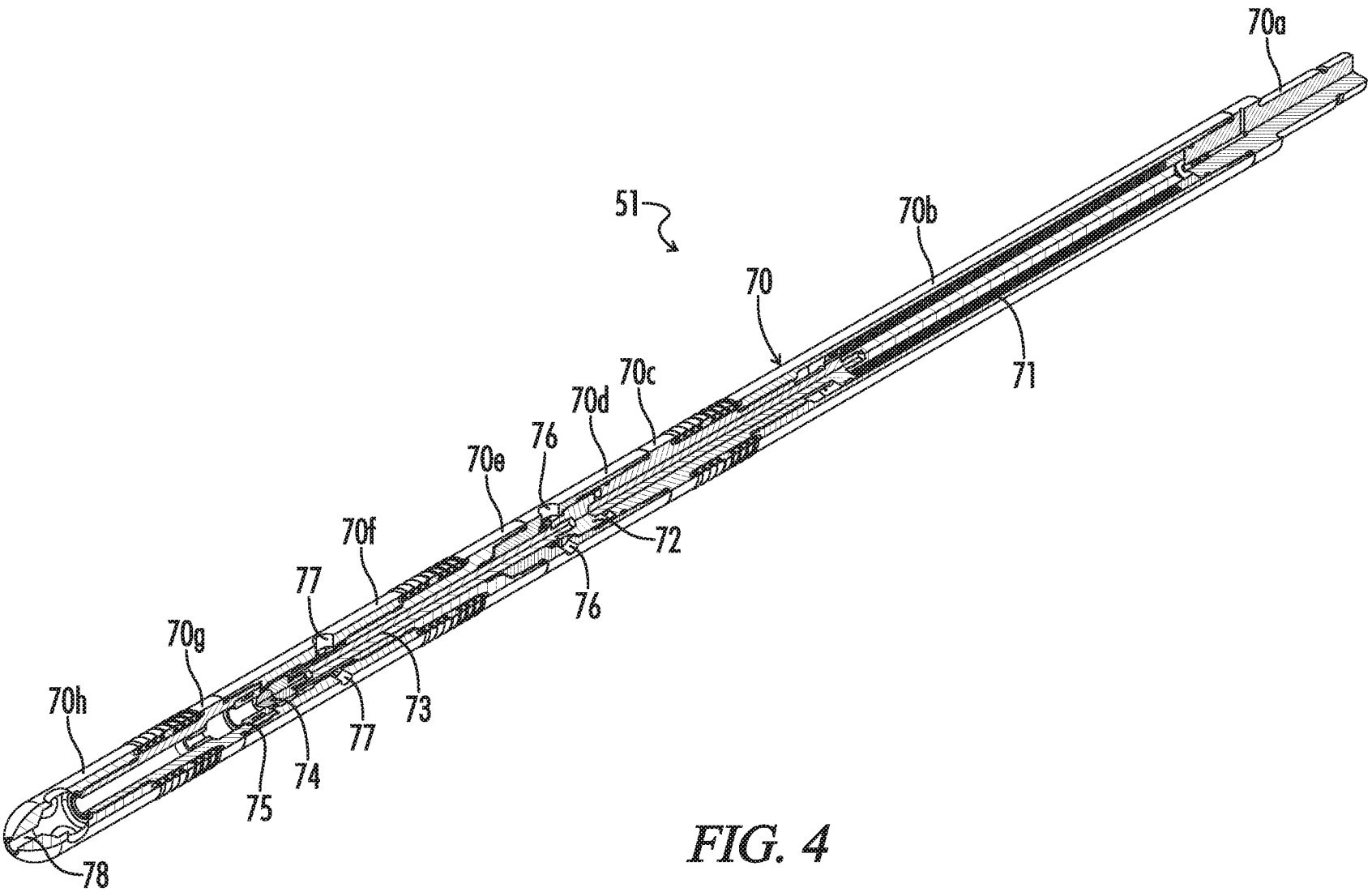
FIG. 4 is an isometric, quarter-sectional view of gas injection valve 51 shown in FIG. 3, showing valve 51 in its normal, closed state.
Figure 5:
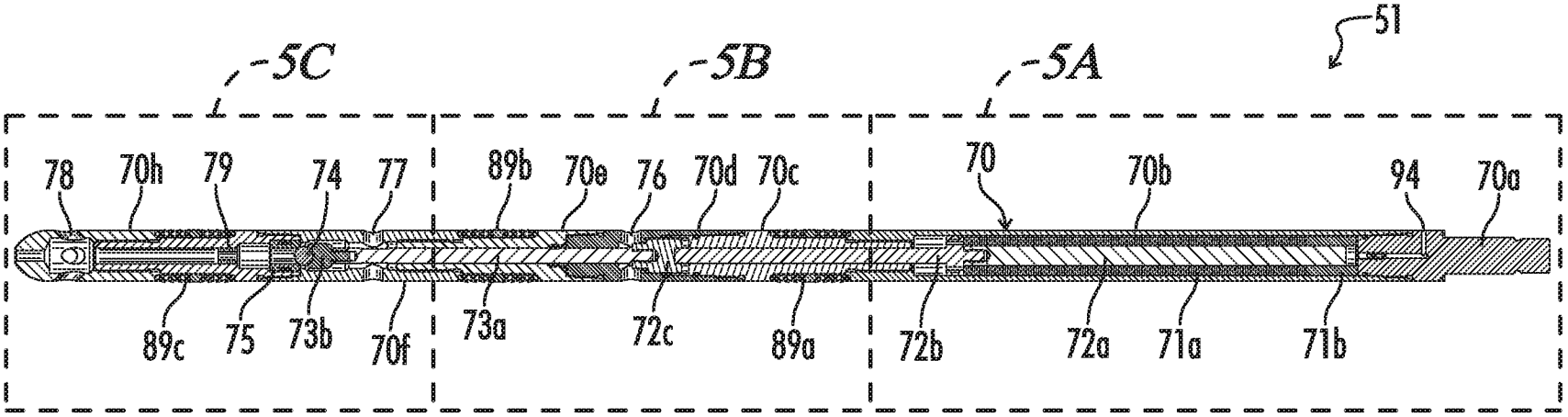
FIG. 5 is a longitudinal cross-sectional view of gas injection valve 51 in its normal, closed state.
Figure 6:
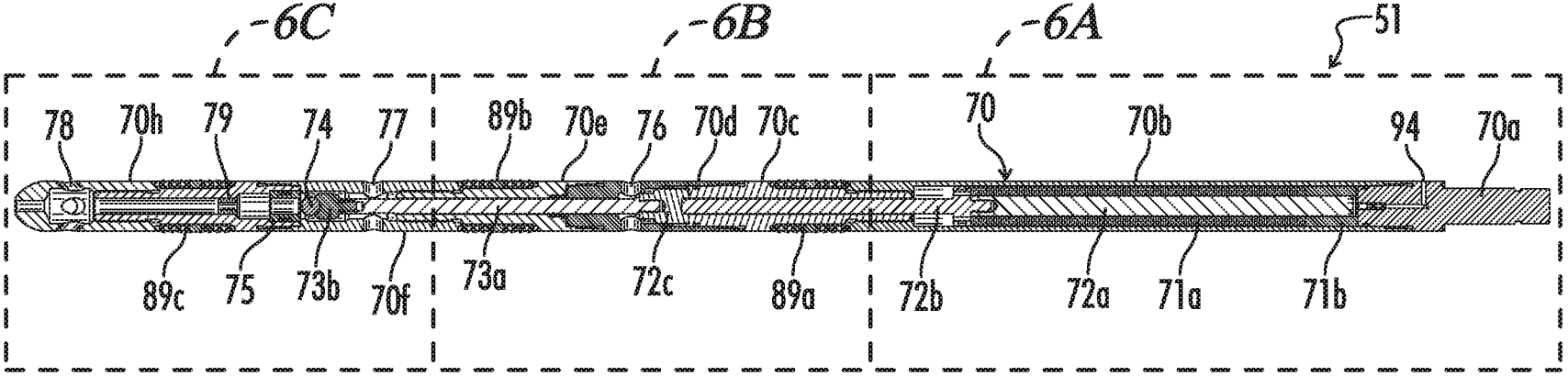
FIG. 6 is a longitudinal cross-sectional view of gas injection valve 51 in its actuated, open state.
Figure 5A:
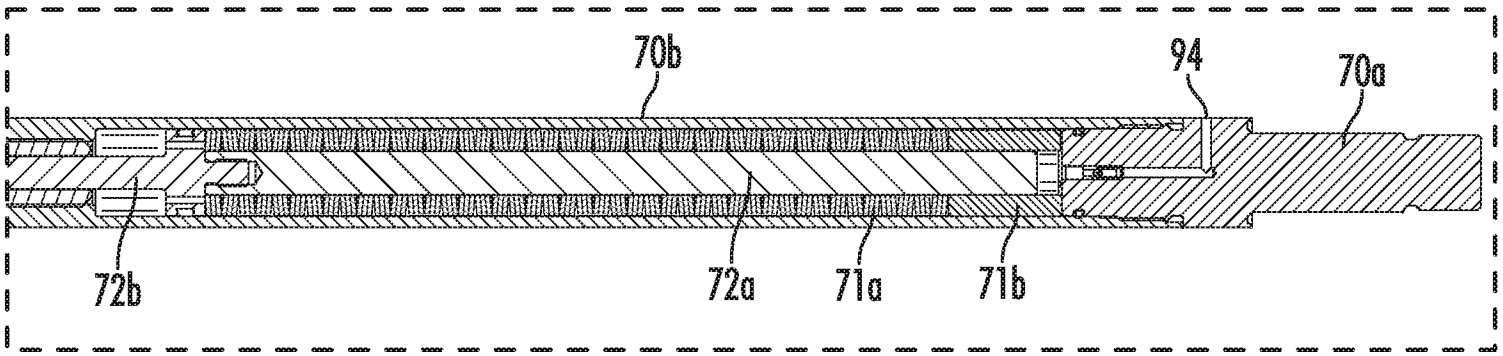
FIG. 5A is an enlarged cross-sectional view taken from FIG. 5 showing the upper portion of gas injection valve 51 in its normal, closed state.
Figure 6A:
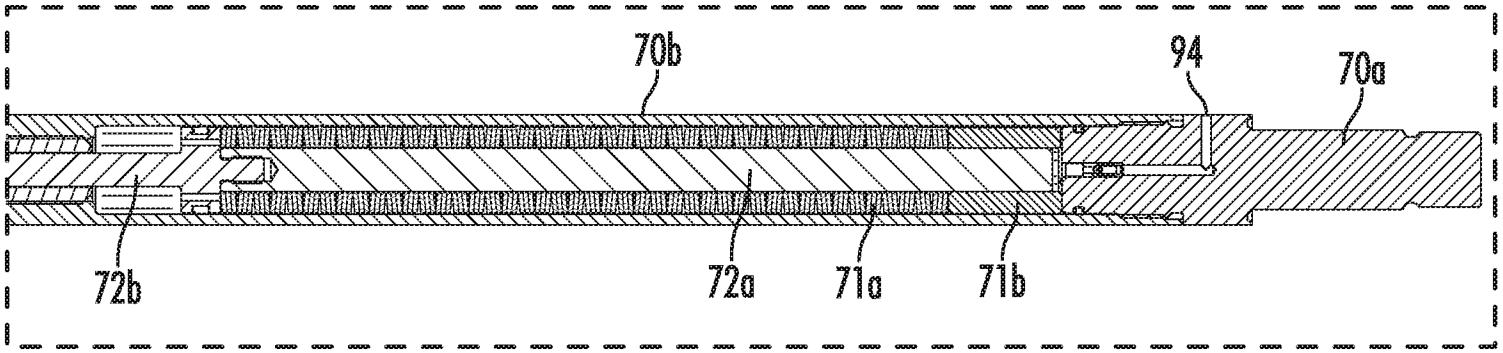
FIG. 6A is an enlarged cross-sectional view taken from FIG. 6 showing the upper portion of gas injection valve 51 in its actuated, open state.
Figure 5B:
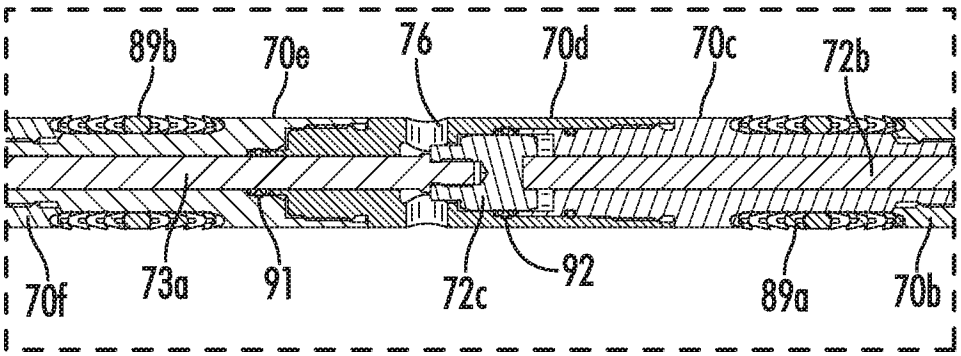
FIG. 5B is an enlarged cross-sectional view taken from FIG. 5 showing the middle portion of gas injection valve 51 in its normal, closed state.
Figure 6B:
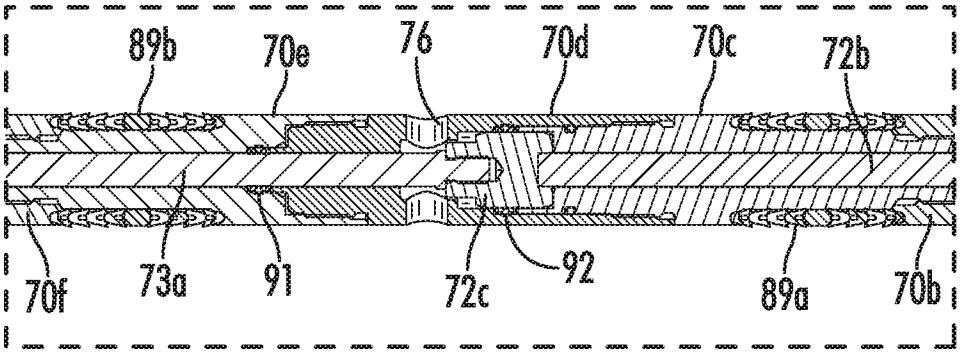
FIG. 6B is an enlarged cross-sectional view taken from FIG. 6 showing the middle portion of gas injection valve 51 in its actuated, open state. 6C is an enlarged cross-sectional view taken from FIG. 6 showing the lower portion of gas injection valve 51 in its actuated, open state.
Figure 5C:
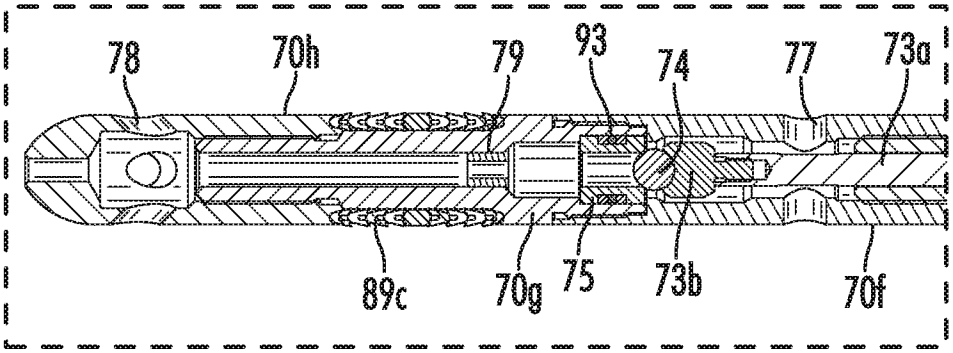
FIG. 5C is an enlarged cross-sectional view taken from FIG. 5 showing the lower portion of gas injection valve 51 in its normal, closed state.
Figure 6C:
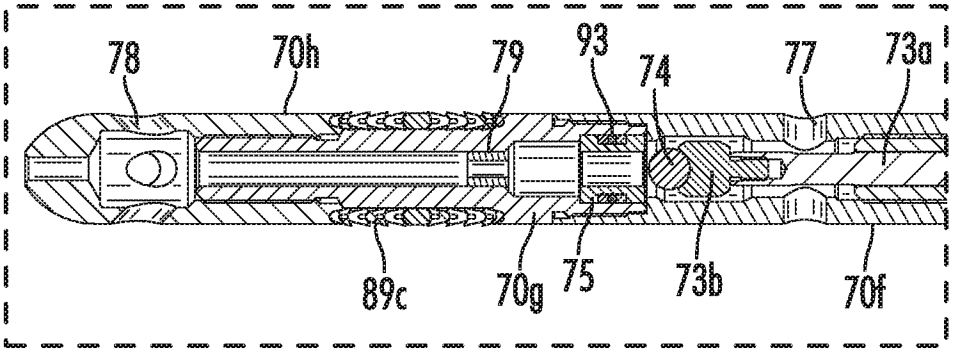
Figure 7:
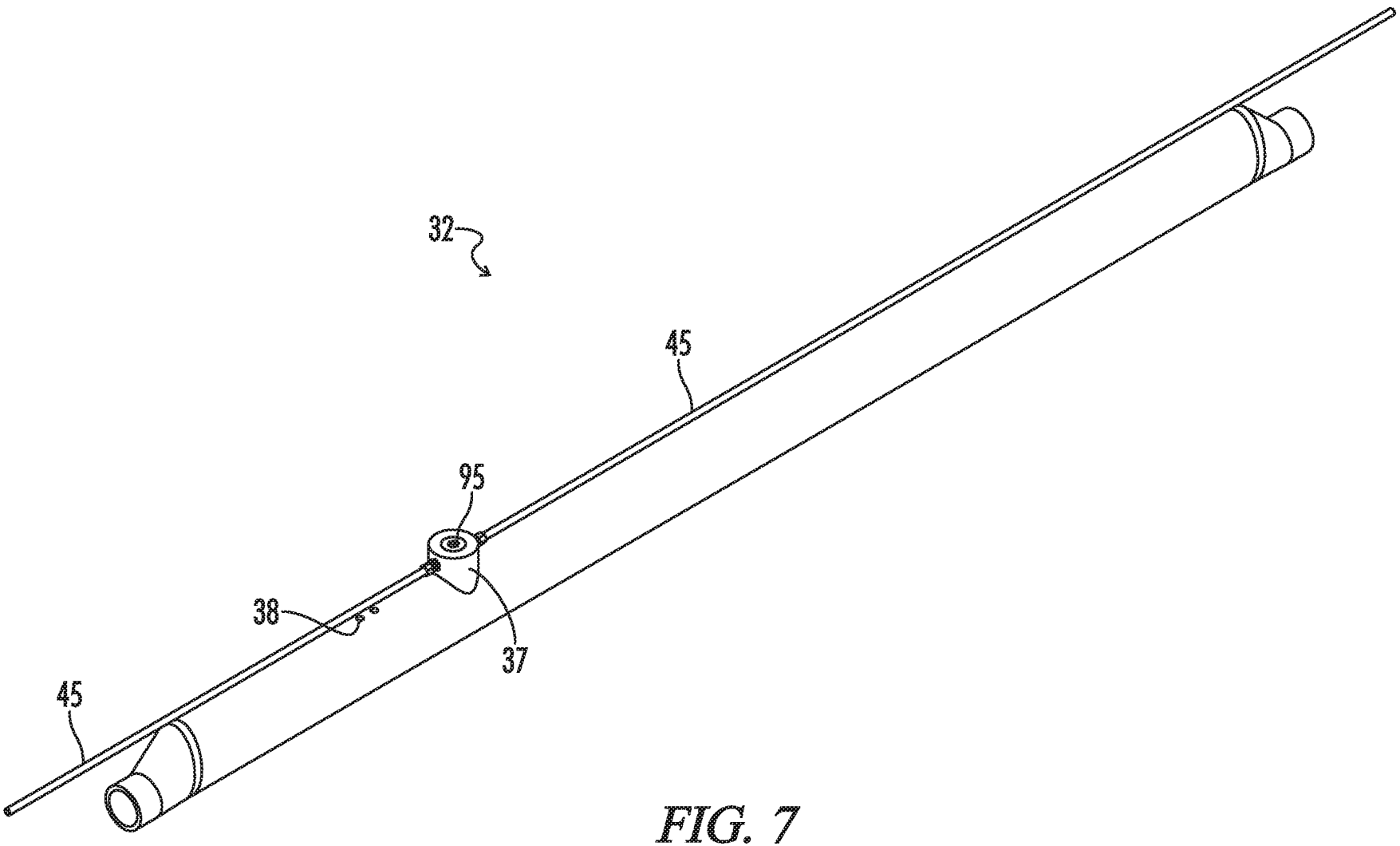
FIG. 7 is an isometric view of a first embodiment 32 of the novel pocket mandrels of the subject invention in which, for example, gas injection valve 51 may be mounted.

FIGS. 2C-2E show well 1 after a first embodiment 30 of the novel gas lift production systems has been installed in casing 20. The operation of gas lift system 30 will be described further below. In general, however, gas lift system 30 comprises, in various stages of artificial lift, a production tube 31, a series of first embodiment 51 of the novel downhole gas injection valves, and valve control line 45.

Valves 51 may be installed in production tube 31 while lift system 30 is being initially installed in casing 20. The hydrostatic pressure in formation 2, however, typically will still be high enough to push oil PF all the way to the surface. Gas injection valves 51 will not be needed as long as oil PF flows naturally to the surface. Thus, as shown in FIG. 2C, dummy valves 50 may be installed in place of continuous gas injection valves 51. Surface equipment required for various stages of artificial lift also need not be installed until liquids no longer flow unassisted to the surface.

Production tube 31 extends through a packer 47. Packer 47 provides a seal between production tube 31 and casing 20, thus diverting production fluids PF from casing 20 into production tube 31. Production tube 31 may be any conventional tubing, such as coiled tubing. Preferably, however, production tube 31 will be assembled from joints of pipe. The joints may be of larger diameter than coiled tubing and thus provide greater production capacity.

As shown schematically in FIG. 2C, production tube 31 preferably includes joints having pocket mandrels, such as a first preferred embodiment 32 of the novel pocket mandrels. Pocket mandrels 32 provide a volume to the side of the main cross-section or "drift" of production tube 31. A receptacle (not shown in FIG. 2C) is provided in that volume to allow valves to be installed, removed, and replaced. As discussed below, the receptacles will have various passages that allow communication with the installed valves. Dummy valves 50 are essentially plugs that shut those passages and prevent fluids from flowing between production tube 31 and annulus 33. Dummy valves 50 also can help reduce the accumulation of debris in the valve receptacles that otherwise might interfere with installation or operation of functional gas lift valves 51 when they are needed.

Production tube 31 also preferably comprises a nipple. The nipple is illustrated schematically in FIG. 2C as a small, internal constriction in production tube 31 and is adapted to receive a production tube check valve 55 (shown in FIG. 2E). Depending on the depth of the well, it may be desirable to provide additional nipples further up production tube 31 so that additional check valves may be installed to reduce the hydrostatic pressure on check valve 55. Conventional nipples suitable for use in the novel systems are available from a number of commercial manufactures, such as the E series seating nipples available from American Completion Tools, Houston, Tex., and the No-Go profile nipples available from Peak Well Systems, Bayswater, Western Australia, Australia.

Overview of Gas Lift Operations

As illustrated in FIG. 1, well 1 may extend for thousands of feet into the earth. The hydrostatic head, that is the weight of fluid PF in production tube 31, will be quite large. After a period of time, the bottom hole pressure behind liquid at the bottom of well 1 will no longer exceed the hydrostatic head in production tube 31. Oil cannot flow naturally to the surface. Thus, FIG. 21) shows production system 30 being used to produce oil PF from well 1 by continuous gas lift.

Novel gas injection valves 51 have been installed in pocket mandrels 32 of production tube 31. A field compressor 13 has been installed at the surface along with a gas switch 16. A portion of the gas produced from well 1 is diverted from the oil-gas separator 12 into field compressor 13. The diverted gas is compressed by compressor 13, typically to pressures of about 1,000 to 1,200 psi, and less commonly up to perhaps 1,800 psi. A portion of the gas is intermittently diverted into gas switch 16 to control valves 51, most of it will be pumped through well head 11 into annulus 33 between production tube 31 and casing 20. Once pumped into annulus 33, flow of gas into production tube 31 is controlled by gas injection valves 51.

The ultimate objective of continuous lift systems is to inject gas into production tube 31 through an operating injection valve 51 at a single station located as deep as possible in the vertical portion 1*v* of well 1. The liquid in annulus 33 between casing 20 and production tube 31, however, must be unloaded before continuous gas lift operations can be initiated. In shallower wells and under certain conditions it may be possible to unload annulus 33 and inject gas through a single operating valve 51. Injection pressures produced by the most common surface compressors may be sufficient to unload all liquid in the annulus through the operating valve.

Most often, however, as in conventional continuous gas lift systems, the well may be too deep to unload fluids efficiently and economically only through the operating valve. Pressures of 5,000 psi or more may be required. For example, pressures of approximately 4,000 psi may be required when the operating valve is at 10,000 ft. The cost of compressors required to produce that injection pressure may make unloading only through the operating valve impractical. Thus, it often is necessary to utilize multiple unloading valves installed at progressively deeper stations above the operating valve to unload the annulus efficiently and economically.

For example, as shown schematically in FIG. 20, gas lift system 30 has several valves 51 installed at progressively deeper stations along production tube 31. Upper valves 51*a*, 51*b*, and 51*c* will serve as unloading valves, while lowest valve 51*d* will provide the operating injection valve after annulus 33 has been unloaded. Lift system 30 is illustrated as having four stations, but the number of stations and valves 51 required will vary, most significantly with the depth of the well and the density of the production fluids. In any event, the stations are located at different depths, typically from about 500 to 1,000 feet apart. Uppermost valve 51*a* typically will be installed well below the surface, perhaps at 2,000 to 3,000 feet. The lowermost valve 51*d* will be installed relatively near the end of production tube 31 at depths of 10,000 feet or greater.

Valves 51 are described further below. In general, however, they are similar to conventional gas injection valves in that they are normally shut. Their valving mechanism is biased in a normally-closed position and is opened by applying an opposing fluid pressure in excess of the biasing force. In contrast to prior art injection-pressure actuated valves that are controlled by the pressure of the gas pumped into the annulus, gas injection valves 51 are actuated by control fluid fed into valves 51 through a single, common control line 45. Control line 45 is connected to all valves 51. Pressure signals transmitted through the control fluid in line 45 will control opening and closing of all valves 51 in system 30.

Any suitable fluid may be used in control line 45, such as natural gas or gas-over-hydraulic. Preferably, however, control line 45 is filled with hydraulic fluid. Hydraulic control lines provide extremely short response times. Pressure signals generated at the surface are rapidly transmitted to valves 51. The pressure head in pneumatic control lines is significantly less, especially for valves installed at greater depths. Thus, the actuation pressure to which the valves are exposed is reduced, and the injection valve may be designed with less biasing force. The same is true to a lesser degree of gas-over-hydraulic lines, where the lower portion of the control line is filled with hydraulic fluid and the upper portion is filled with gas.

Both pneumatic and gas-over-hydraulic control lines, however, have significantly slower response times. Both types of control fluid systems ultimately rely on pressure adjustments in relatively large volumes of gas, thus causing considerable lag between initiation of a pressure signal at the surface and actuation of the valve. The system can be controlled more closely with the shorter response times provided by hydraulic control lines. More responsive control systems are particularly important when, as described below, novel injection valves 51 are used in intermittent gas lift.

Hydraulic pressure signals can be generated in control line 45 by a hydraulic pump, accumulator, and control system installed along with the other surface equipment. Preferably, however, pressure signals through control line 45 will be generated by gas switch 16. Gas switch 16 is installed in a line running from field compressor 13 and communicates with control line 45. It has a relatively small chamber. Thus, it may be filled quickly with compressed gas from field compressor 13 to increase the fluid pressure in control line 45. Gas also may be bled out of gas switch 16 quickly to decrease the fluid pressure in control line 45. Initially, however, gas switch 16 is charged and opened to raise the fluid pressure in control line 45 to a level sufficient to open all injection valves 51 installed along production tube 31.

Unloading of annulus 33 is initiated by pumping gas at controlled rates and pressures into annulus 33. Liquid in annulus 33 will be forced into production tube 31 through all injection valves 51. Initially, gas pressure in annulus 33, that is, the casing pressure will increase steadily, generally linearly as the volume of liquid in annulus 33 is displaced into production tube 31 increases. Eventually, the liquid level in annulus 33 drops below the uppermost, unloading injection valve 51*a*. Gas will begin flowing through valve 51*a* into production tube 31. The casing pressure will drop noticeably, confirming to surface controls and observers that gas in fact is flowing through valve 51*a*.

As the operation continues, liquid in annulus 33 continues to flow into production tube 31 through lower valves 51*b*, 51*c*, and 51*d*. The liquid level in annulus 33 continues dropping until it drops below the next lower valve 51*b*. As gas begins flowing through valve 51*b*, the casing pressure again drops noticeably, confirming that gas is flowing through valve 51*b*. Pressure then can be bled off gas switch 16, lowering the pressure in control line 45 and allowing uppermost valve 51*a* to return to its normal, closed state. Lower valves 51*b*, 51*c*, and 51*d* remain open.

The operation continues. Gas flows into production tube 31 through unloading valve 51*b* and liquid flows from annulus 33 into production tube 31 through valves 51*c* and 51*d*. Liquid levels in annulus 33 reach progressively deeper valves 51*c* and 51*d*, corresponding pressure drops are detected, and valves 51*b* and 51*c* are shut in succession by bleeding gas stepwise out of gas switch 16 until only the deepest, operating valve 51*d* is open. Gas in annulus 33 then flows through injection valve 51*d* into oil PF flowing up production tube 31. The density of oil PF will be reduced, thus reducing the weight of the column of oil in production tube 31. Oil PF now is able to continue flowing to the surface.

After an additional period of time, well 1 will be further depleted and its bottom hole pressure further diminished. More and more gas must be injected into production fluid PF to reduce its weight below the formation pressure. At a certain point, oil PF will simply fall out of the injected gas and remain in production tube 31. Thus, FIG. 2E shows production system 30 being used to produce oil PF from well 1 by intermittent gas lift.

Unlike continuous lift, which injects a continuous, relatively low-volume flow of gas into a production stream, intermittent lift relies on the periodic, but rapid injection of relatively large volumes of gas. A bubble of gas is formed in the production tubing that lifts the oil above it toward the surface. Thus, as shown in FIG. 2E, a production tube check valve 55 typically will be installed in production tube 31 to prevent oil from being pushed down into well 1 as gas is injected rapidly into production tube 31. Additional check valves may be installed further up production tube 31 in order to reduce the hydrostatic pressure on production tube check valve 55.

Intermittent lift can be initiated by bleeding pressure out of gas switch 16 until operating valve 51*d* closes. A surface valve (not shown) then will be shut, isolating gas switch 16 from control line 45. Gas is pumped into annulus 33 until the casing pressure is relatively high. At the same time gas switch 16 is recharged. The surface valve is opened, and gas switch 16 will transmit a near instantaneous pressure signal through control line 45 that will re-open operating valve 51*d* rapidly. When the desired volume of gas has been injected, gas switch 16 will be bled off, allowing operating valve 51*d* to shut again. After a period of time, the cycle will be repeated to form another gas bubble that will lift another slug of oil to the surface.

In the last stages of a well's production cycle it may not be practical to continue intermittent gas lift. The well's bottom hole pressure will have dropped even more. Fallback of oil though the gas and the volume of gas required may rise to unacceptable levels. Thus, an operator may choose to use plunger-assisted gas lift or to install a gas pump (not shown) to produce the remaining oil in well 1.

Conventional plunger systems may be used, as may be conventional gas pumps. Many such systems are available commercially. Plungers systems typically will involve the installation of additional surface equipment. Conventional gas pumps would be installed by removing the production tubing along with the other downhole equipment needed for continuous and intermittent injection. Preferably, however, gas pumps as disclosed in applicant's pending patent applications: "Gas Pump System," Ser. No. 15/984,907, filed May 21, 2018, and "Gas Pump System," serial no. TBA, filed Sep. 22, 2020, will be utilized, and the novel gas lift systems will be incorporated into a life-of-the-well system as disclosed therein. The disclosure contained in those patent documents are incorporated herein in their entirety by this reference. In the event of conflict with the incorporated disclosure, unless arising from obvious error, the disclosure provided in this incorporating application shall control.

It will be appreciated that the schematic representations of gas lift system 30 have been simplified in many respects, A variety of control and safety valves, chokes, meters, and gauges may be incorporated into the surface equipment. Booster compressors and accumulators may be provided in the high-pressure gas supply system. Hydraulic systems may be provided to operate valves and other equipment. Controllers and other auxiliary equipment may be installed so that the system may be operated automatically, and data may be recorded and displayed. Likewise, the packers, tubing, and many other components of the illustrated systems typically will have various features that, for example, enable them to be installed or retrieved, but are not shown in the figures.

Similarly, it will be appreciated that the operations described are illustrative and simplified in certain respects as well. For example, once the formation pressure is no longer able to push liquids all the way to the surface, it likely still is able to push flow well up the production tubing. Formation pressure will diminish gradually. Thus, the well may be unloaded over an extended period of time. An upper unloading valve may serve as a transient operating valve for some time, especially if the rate of decline in the formation pressure is very slow. It may be quite a while before it is necessary to unload the annulus to the level of the lowermost, ultimate operating valve.

It also will be appreciated that lowermost, operating valve 51*d* in lift system 30 will always be open. There rarely, if ever, will be a need to close valve 51*d* during gas lift operations. Thus, the lowermost valve in the novel gas systems may not be connected to the control line controlling actuation of upper valves in the system. It may be a conventional, injection-pressure activated valve set to open at low casing pressures, or it simply may be a choke installed in production tube 31.

The novel systems in large part may be assembled from conventional equipment. Field compressor 13 and gas switch 16, for example, are typical of equipment commonly employed in pneumatic systems for oil and gas wells. They typically will incorporate meters, sensors, controllers, and other auxiliary components that enable them to be operated automatically. Preferred gas injection valves and pocket mandrels are disclosed in greater detail below. In general, however, the other downhole equipment may be of any conventional design and are available from a number of manufacturers. Suitable production check valves, for example, may include standing valves available from Peak Well Systems, E-3 series standing valves available from American Completion Tools, and A-2 Series standing valves sold by Schlumberger.

Embodiments of the novel gas lift systems also may incorporate conventional pressure-actuated gas injection valves. Many conventional gas injection valves may be adapted for control through a single, common control line as described above, such as WP series valves from Dover Artificial Lift, BK series injection valves from Schlumberger Limited, Houston, Tex., and R-1 series injection valves Weatherford International, Houston, Tex. It is expected that such conventional gas injection valves may be used effectively in some oil and gas wells. Preferably, however, the novel systems incorporate novel gas injection valve 51 or other embodiments of the novel gas injection valves.

Overview of First Preferred Downhole Gas Control Valve

First preferred embodiment 51 of the novel downhole gas control valves is shown in greater detail in FIGS. 3-10. Valve 51 is a gas injection valve. As may be seen therein, it generally comprises a housing 70, a stack of Belleville washers 71, a piston assembly 72, a stem assembly 73, a valve body 74, and a valve seat 75. Washer stack 71, piston assembly 72, stem assembly 73, and valve body 74, as described further below, are operationally coupled such that injection valve 51 is normally closed by a biasing force generated by washer stack 71 and may be opened by applying control fluid pressure to piston assembly 72.

Valve housing 70 provides the base on and in which the other valve components are assembled. It has a generally open, elongated cylindrical shape. As exemplified, housing 70 is approximately 1" in diameter and has a length of about 18". Other embodiments typically will be no more than 2" in diameter and 60" in length, but may have larger dimensions. In general, it is preferable that the size be minimized while still allowing for the required flow rates and other operational requirements of the valve. That shape and those dimensions allow valve 51 to be run through and installed in production tube 31 easily while minimizing any constriction it may present once installed. The outer circumference of housing 70 is profiled, as is its inner circumference to allow the other valve components to be mounted on and in housing 70. As described further below, housing 70 also provides various chambers and flow paths into which control fluid may be introduced and through which gas may flow.

Preferably, as shown, housing 70 is assembled from eight subs 70*a* to 70*h*, for example, by threaded connections. Multiple subs 70*a* to 70*h* simplify the manufacture of housing 70 and facilitate installation of the other valve components. Housing 70 may be assembled from more or fewer subs, however, if desired.

Piston assembly 72 extends axially through housing subs 70*b* to 70*d* and generally comprises a washer post 72*a*, a piston rod 72*b*, and a piston head 72*c*. Piston head 72*c* is mounted for reciprocating axial movement in a piston cylinder defined by housing subs 70*c* and 70*d*. Piston seals 92 are mounted between piston head 72*c* and the inner wall of the piston cylinder, for example, in a gland formed by the lower end of housing sub 70*c* and a facing shoulder in housing sub 70*d*. Piston seals 92 may be selected from conventional pressure seals and packings, such as a packing having two sets of outward facing, elastomeric cup seals separated by a hard backup ring.

Piston rod 72*b* is coupled at its lower end to the upper (low pressure) side of piston head 72*a*. It extends upward through a passage in housing sub 70*c* and into a cylindrically shaped chamber defined by housing sub 70*b*. A disc-like, enlarged outer diameter portion is provided near the upper end of piston rod 72*b*. The upper end of piston rod 72*b* is connected, for example, by threaded connections, to washer post 72*a* which extends upward through most of the chamber in housing sub 70*b*.

Washer stack 71 bears on the upper end of piston assembly 72 and extends axially upward from piston assembly 72 through housing sub 70*b*. It comprises a plurality of Belleville washers 71*a*. Washers 71*a* preferably are loaded around washer post 72*a* in the chamber defined by housing sub 70*b*. Clearance is provided so that washers 71*a* can shift within housing 70*b* as they are compressed and as they relax. Preferably, as shown, washer stack 71*a* also comprises a washer blank 71*b*. When it is assembled to housing sub 70*b*, uppermost housing sub 70*a* will bear on washer blank 71*b* to partially compress washers 71*a*, The lowermost washer 71*a* bears on an annular upper surface of the disc on piston rod 72*b*, thus generating a load on piston assembly 72 that will bias it toward a normal, downward position in which valve 51 is closed.

Stem assembly 73 is coupled to the lower end of piston assembly 72 and extends axially downward through housing subs 70*d*, 70*e*, and 70*f*. It generally comprises a stem rod 73*a* and a valve body capture 73*b*. Stem rod 73*a* is connected at its upper end to the lower side (pressure face) of piston head 72*c*. It extends axially downward from piston head 72*c* through housing sub 70*d*, housing sub 70*e*, and into a chamber defined by housing sub 70*f*. Stem seals 91 are mounted between stem rod 73*a* and the inner wall of housing 70, for example in a gland formed by the lower end of housing sub 70*d* and a facing shoulder in housing sub 70*e*. Stem seals 91 may be selected from conventional pressure seals and packings, such as the packings used for piston seals 92. Valve body capture 73*b* is coupled to the lower end of stem rod 73*a*.

Valve body 74 preferably, as shown, is a ball adapted to seat upon and seal against valve seat 75. The lower face of capture 73*b*, therefore, is provided with a generally hemispherical recess into which valve body 74 is mounted. Valve seat 75 is a relatively short, generally open cylindrically shaped body or sleeve. It is mounted in an enlarged inner diameter portion at the upper portion of housing sub 70*g*. Seat seals 93, such as conventional elastomeric seals and packings, preferably are provided between valve seat 75 and housing sub 70*g*. The upper end of valve seat 75 is beveled to provide an upward-facing seal surface upon which ball 74 will bear.

Both ball 74 and valve seat 75, therefore, may be easily replaced when worn. If desired, however, valve stem assembly 73 may be provided with an integral valve body, and an integral valve seat may be provided, for example, in housing sub 70*g*. Likewise, the valve body and seat may have different, conventional geometries, notwithstanding that valve body 74 may be referred to herein as a "ball."

Valve housing 70 and valve seat 75 provide a gas flow path through valve 51. More specifically, housing sub 70*f* is provided with ports 77 extending radially through its wall and defines a gas supply chamber. When ball 74 is unseated from valve seat 75, gas can enter valve 51 through inlet ports 77, and then flow axially through the supply chamber, through valve seat 75, through an axial passage in housing sub 70*g*, and out gas outlet ports 78 provided in housing sub 70*h*. Preferably, as shown, a choke 79 is provided in the gas flow path, for example, below valve seat 75 in the passage in housing sub 70*g*. Choke 79 preferably is removably mounted in the passage, for example, by threaded connections so that chokes of different sizes may be used with otherwise identical valves 51. The volume of gas flowing through valve 51, therefore, may be easily optimized for different flow pressures.

Stem seals 91 and piston seals 92 define a control fluid actuating chamber within housing sub 70*d*. Control fluid may be introduced into the actuating chamber to generate pressure against piston head 72*c*. Seals 91 and 92 isolate pressure within the chamber from the gas flowpath and other portions of valve 51. Thus, gas injection valve 51 may be operated by sending pressure signals to increase or lower fluid pressure in the actuating chamber. When fluid pressure in the actuation chamber is lower than the biasing force of washer stack 71, washer stack 71 biases piston assembly 72 in its normal, closed position. Stem assembly 73 is extended and ball 74 is held against valve seat 75. Flow through valve seat 75 and valve 51 is shut off.

Valve 51 may be opened, however, by sending a pressure signal through control line 45. Control fluid flows into valve 51 via radially-extending control fluid ports 76 provided in housing sub 70*d*. Fluid pressure in the actuation chamber exceeds the biasing force of washer stack 71. Piston assembly 72 is urged upward against washer stack 71. As piston assembly 72 travels upward, it compresses washer stack 71 and pulls stem assembly 73 upward and ball 74 off valve seat 75. The upper end of the piston cylinder in housing sub 70*c* provides a stop, limiting travel of piston assembly 72. Gas can flow from annulus 33 into valve 51 through inlet ports 77, through valve seat 75, and out valve 51 through outlet ports 78. Valve 51 may be closed again by bleeding pressure out of control line 45. Washer stack 71 will expand and push piston assembly 72 downward and ball 74 back onto valve seat 75.

It also will be appreciated that washers 71*a* compress, and that piston assembly 72, stem assembly 73, and ball 74 reciprocate along the primary axis of housing 70. They are all in alignment. Thus, valve 51 may be provided with a compact, cylindrical shape suitable for use in downhole systems. It may be installed easily and minimally constricts flow through production tube 31. Wear in valve 51 is reduced and its service life will be extended by restricting movement along a single axis.

Preferably, as shown, uppermost housing sub 70*a* is provided with an equalization port 94 to relieve pressure that may build up during operation of valve 51. Pressure in the actuation chamber may be quite high. Any leakage of actuation fluid through piston seals 92 will introduce fluid into the passages and chambers within housing subs 70*b* and 70*c*. If not evacuated, pressure can build within subs 70*b* and 70*c* and increase the force needed to actuate piston assembly 72. Thus, the disc-like end of piston rod 72*b* is provided with axial ports allowing leaked actuation fluid to flow into the chamber in housing sub 70*b*. From there leaked fluid can flow out of valve 51 through equalization port 94. A check valve (shown schematically) preferably is provided to allow actuation fluid to flow out equalization port 94, but to block the flow of gas or other fluids into valve 51 from annulus 33.

It will be appreciated that the novel gas injection systems and valves offer significant advantages over prior art systems and valves. For example, valves 51 in gas injection system 30 may be controlled more easily and reliably and their open-closed state may be determined more accurately. Prior art systems utilize injection-pressure actuated valves. The operation of those valves is controlled by regulating the casing pressure, that is, the gas pressure in the annulus. They are opened by increasing the casing pressure and closed by decreasing it. In particular, once liquid has been unloaded from the annulus, the lowermost, operating injection valve will be held open by controlling the casing pressure.

Casing pressure, however, cannot always be controlled within designed limits by the equipment and controllers at the surface. While determined in large part by the rate at which gas is pumped into the annulus, downhole conditions can affect casing pressure. It can fluctuate, for example, because gas leaks through the cement sheath surrounding the production casing or because the temperature in the well has changed. Production pressure in the tubing also affects casing pressure. For example, fluctuations commonly occur when neighboring wells are fractured. Close-by fracturing can increase the formation pressure of the well. Formation pressure also changes over time, generally decreasing, but also occasionally increasing for relatively short periods of time. Those changes can affect the proportion of gas in the production fluid, that is, the gas cut. As the gas cut varies, so will the hydrostatic head in the production tubing and, in turn, the casing pressure required to hold the valves open.

Prior art systems, therefore, can be unstable and require frequent adjustments. If necessary adjustments are not made in a timely fashion, valves in the system may open or close unexpectedly, likely reducing the effectiveness of lift operations and creating more instability in the system. Making matters worse, it may not always be possible to determine easily and accurately what valves are open in the system and to stabilize the system.

In contrast, novel gas valves 51 in lift system 30 are controlled independent of, and are unaffected by fluctuations in either the casing pressure in annulus 33 or the hydrostatic pressure in production tube 31. They are controlled by pressure signals through control line 45. The state of each valve may be controlled with precision at all times during lift operations. Moreover, the state of each valve 51 in system 30 may be ascertained readily by reference to the pressure in control line 45 and the actuation pressure of valves 51.

Moreover, because valves 51 are controlled through control line 45 and independent of casing pressure, the casing pressure in annulus 31 may be optimized to inject gas through the operating valve at whatever pressure is required for a desired volume of gas that will optimize production from the well. The operating valve also may be installed at a depth that will optimize production.

Under certain circumstances, for example, lift may be improved by injecting more gas through the operating valve into the production tubing. Absent a variable orifice in the operating valve, that may only be accomplished by increasing the casing pressure. In conventional systems with injection-pressure actuated valves, however, casing pressure and gas flow through the operating valve is limited by the presence of the unloading valves in the system.

That is, the upper unloading valves in conventional systems have progressively higher actuation pressures. If the casing pressure is increased above the actuation pressure of the higher-up unloading valves, flow through the operating valve will be diminished, not increased. The upper valves will open, and gas will flow preferentially through them. To the extent that gas is injected through upper unloading valves instead of the lowermost operating valve, production will be diminished. Thus, it may not be possible to optimize the casing pressure in conventional gas lift systems. In worst cases, it may not be possible to increase the casing pressure to a level required to provide the minimum gas velocity in the production tubing that is required to move liquid droplets upward. It may be necessary to inject gas higher up in the well and accept a reduction in production rates.

Importantly, gas lift system 30, for example, also provides an opportunity to avoid having to tune individual valves 51 relative to each other. In prior art lift systems having injection-pressure actuated valves, the biasing force generated by the valve's resilient element must be tuned individually relative to that of other valves in the system. The actuating pressure of the valves necessarily must drop from station to station as the depth of the station increases.

In contrast, all valves 51 in lift system 30 may be tuned to the same actuating pressure regardless of the depth at which it will be installed. That is, the biasing force of washer stack 71 will be set to hold valve 51 in its normally-closed state until it is actuated. The minimum biasing force for a particular valve, therefore, will depend on the depth at which valve 51 will be installed. At a minimum, it must exceed the pressure head of control fluid in control line 45 at that depth. Preferably, it will be set somewhat above the anticipated pressure head to allow for some fluctuation in hydrostatic pressure and imprecision in the design and manufacturing of valves 51.

The biasing force of all valves 51 in gas lift system 30, however, may be set to the level required to hold the lowermost, operating valve 51*d* in its normally-closed state. The fluid pressure in control line 45 is at its maximum, and valve 51*d* may be opened by relatively low-pressure signals generated at the surface through gas switch 16. The fluid pressure in control line 45, however, is much lower at the uppermost unloading valve 51*a*. Its actuation pressure is the same as valve 51*d*, so valve 51*a* will require a much greater pressure signal to open. At progressively deeper stations, valves 51 will require progressively lower pressure signals to actuate them. Valves 51 may be identical in all respects, and still be controlled by pressure drops in a single, common control line 45.

The design of gas system 30, therefore can be simplified greatly. A valve 51 that is tuned and rated for actuation at the deepest station can be used for all valves 51 in system 30. Moreover, given that flexibility, it may not be necessary to manufacture or stock valves with as many different ratings. Valves rated for actuation at 10,000 feet, for example, may be suitable for much shallower wells as well as those where the operating valve will be installed at 10,000 feet.

Novel valves 51 of course still must be tuned so that washer stack 71 holds them in their normal, closed state up to a given depth or, more precisely, up to a given hydrostatic pressure in control line 45. They also must be tuned to ensure that their stroke or travel distance will lift ball 74 sufficiently clear of seat 75. Moreover, if desired, the actuation pressure for valves 51 may be tuned so that their activation pressure increases as the depth of the station increases. That will allow the uppermost valve 51 to be opened by generating a lower-pressure pressure signal in control line 45. Regardless, however, tuning of valves 51 is greatly simplified as compared to conventional gas injection valves because they rely on washer stack 71 to hold them in their closed state until actuated.

Conventional valves where a resilient biasing force is provided by a pressure-responsive bellows are tuned for specific depths by charging the sealed chamber surrounding the bellows to a specific pressure. The charge required for a particular biasing force and stroke must be calculated in view of anticipated well temperatures and other factors. Providing the appropriate charge also is a more complicated manufacturing process, requiring multiple steps and specialized equipment.

In contrast, the biasing force generated by washer stack 71 in valve 51 may be tuned much more easily. For a given washer, washer stack 71 may be tuned to provide an appropriate biasing force and stroke by varying the number and arrangement of washers 71*a*. Washer stack 71, for example, has 44 sets of 3 Belleville washers. Belleville washers, also known as disc or cone springs, are relatively flat and washer-like springs typically fabricated from high tensile strength steel. Their centers are raised slightly as compared to their periphery, thus given them the shape of a very short, top-truncated cone. That shape gives them a very high spring rate or, put another way, the amount of deflection of Belleville washers increases very slowly as load on the washer is increased.

The washers in each three-washer set are stacked in series, that is, with the washers nested within each other. The sets are stacked in parallel, that is, with each set installed in alternate orientations, either pointing up or down. More or fewer washers, however, may be used, and the stacking of the washers may be varied to provide the washer stack with appropriate load profiles for desired amounts of compression or travel When the washers are stacked in series, the load required for a given amount of travel is cumulative. In a four-washer set, for example, the load will quadruple over the load required to produce the same deflection in a single washer. When the four-washer set is stacked in parallel, however, the same load will produce four times the amount of travel. Regardless of how the individual washers are stacked, however, the spring rate (load vs. deflection) is largely linear, Thus, the load and travel profile of washer stack 71 may be adjusted easily by selecting an appropriate number of washers 71*a* and an appropriate stacking pattern.

Designing and building bellows-type injection valves also becomes more problematic as the depth at which they will be installed increases. The bellows necessarily must generate a corresponding increase in biasing force. That increased biasing force is provided by a corresponding increase in the pressure to which the bellows is exposed. Managing the effects of increasing pressure on the bellows can be challenging and not always successful. Moreover, as the charge increases, other factors being equal, the actuation pressure required to yield the same stroke increases exponentially.

Thus, design tolerances narrow, and failure becomes more likely as the charge in a bellows-type valve increases.

Novel gas injection valve 51, for example, presents no such issues. Washer stack 71 may be provided with as many washers 71*a* as may be required for a particular depth. No special or additional manufacturing steps are required as compared to a valve designed for shallower depths. There also is no diminution in the reliability of the valve. Valve 51, for example, is designed for installations up to 10,000 feet deep.

Moreover, even as compared to other types of springs, such as coiled compression springs, washer stack 71 is much better suited for installations at depth. Washer stack 71 can provide the required biasing force and stroke in a relatively compact assembly. The spring rate, that is the load versus deflection characteristics for Belleville washers and coiled compression springs are very different, Both are linear, but Belleville springs reach very high loads in a relatively small amount of deflection. Coiled springs, in comparison, have lower forces over much larger deflections. Thus, conventional coiled springs would require a much larger diameter or much greater length to provide the same spring rate as washer stack 71. The valve necessarily would be correspondingly larger, making it more difficult to manipulate and install downhole.

In addition, as noted above, valves in conventional gas lift systems are closed in succession by a series of drops in the casing pressure. The casing pressure and, in turn, the gas flow through the lowermost, operating valve thus is limited by the presence of the uphole unloading. In conventional systems, therefore, the pressure drop between each valve must be minimized. Typically, the pressure drop is between 20 and 30 psi. Otherwise the casing pressure after all the unloading valves have been closed may not be sufficient to inject the required amount of gas into the production tubing through the operating valve.

Minimizing the pressure drop, however, necessarily requires that the resilient element, such as a pressure-responsive bellows, have a very low spring rate. The valve must stroke to a fully open position, and return to a fully closed position in response to relatively small changes in pressure applied to the resilient element. The injection valves in the novel systems, however, are controlled by pressure signals transmitted through a control line, not through the casing pressure. The pressure gap required to actuate the valves of the novel systems, such as valves 51, is not constrained by the casing pressure.

Thus, the novel systems may use valves, such as valve 51, that have a high spring rate. A higher pressure can be applied through control line 45 to fully stroke valve 51*b*, for example, without opening valve 51*a*. The greater pressure differential between valves 51 in gas lift system 30 also allows more accurate identification of which valves 51 are open or closed. In lift system 30, fir example, the actuation pressure differential may be about 350 psi, a differential that is not practically achievable in conventional systems except in the shallowest of wells with only a few injection stations.

Finally, as discussed above, most continuous gas injection systems unload fluid in the annulus and inject gas into a production stream flowing up the production tubing. In some wells, however, an operator may prefer to inject gas into the annulus and produce those fluids through the annulus, instead of through production tubing. Conventional gas lift systems designed to inject gas into oil produced through the annulus are similar to those that inject gas into oil produced through production tubing. Production tubing still will be installed in the well. There are, however, differences between the two types of systems.

Instead of installing a packer between the production tubing and the casing, a plug will be installed at the end of the production tubing to force fluids up the annulus. Different injection valves typically are required for the different systems. Some valves may be adapted for use in both types of systems, but the way they are mounted on the production tubing must be modified to inject gas into the annulus. Different pocket mandrels, for example, will be required.

The downhole components of novel gas lift system 30, however, may be used to produce oil through the annulus without any modification other than installing a plug in production tube 31 instead of packer 47. Because they are all controlled by a common control 45, gas lift valves 51 may be used without modification for unloading production tube 31 and injecting gas into annulus 33. Pocket mandrels 34 also may be used without modification, Surface lines will require reconfiguration, but otherwise common control line 45 provides gas lift system with flexibility that is lacking in prior art gas injection valves and systems. Lift system 30 and valves 51 can easily be used to unload either annulus 33 or production tube 31 and to inject gas into production tube 31 or annulus 33.

The novel gas injection valves may be connected directly to the common control line. Similarly, they may be mounted on production tubing in any conventional manner. Preferably, however, the gas injection valves are adapted to be retrievably mounted on the production tubing, and preferably such that they may be installed, retrieved, and replaced through the production tubing. Preferred embodiments of the novel systems, therefore, incorporate pocket mandrels into the production tubing. The pocket mandrels have receptacles into which the valves may be installed. Preferred embodiments of the pocket mandrels also include a poppet valve.

In novel system 30, for example, gas injection valves 51 are mounted in novel pocket mandrels 32 that are assembled into production tube 31. Pocket mandrels 32, with valve 51 mounted therein, are shown in greater detail in FIGS. 7-10. As shown therein, pocket mandrels 32 are generally tubular, but have a generally oval cross-section. That cross-section creates a volume or pocket 34 outside the drift 35 of production tube 31. Pocket 34 can accommodate valves 51, as seen best in sectional views of FIGS. 8-9. By offsetting pocket 34 outside the drift 35, passage through production tube 31 is unrestricted.

More particularly, relatively short tubular receptacles 36 are provided in pockets 34. Valves 51 have an elongated, generally cylindrical shape. Their lower end, their "nose," is generally tapered to a somewhat rounded point, allowing valves 51 to be more easily inserted into receptacles 36. Preferably, as shown, the outer circumference of uppermost housing sub 70*a* is profiled such that it may be engaged by a latch assembly (not shown). As discussed in greater detail below, the latch assembly will enable a slickline tool to attach to valves 51 so that they can be deployed and retrieved.

Referring to FIGS. 7-10, it will be appreciated that receptacle 36 is adapted to allow gas to flow from annulus 33, through valve 51, and into production tube 31. For example, receptacle 36 has passages 38 through its external wall in the vicinity of gas inlet ports 77 in gas injection valve 51. Passages 38 allow gas to flow from annulus 33 into the interior of receptacle 36. Receptacle 36 also has a lower end that is open to the interior of production tube 31. The open lower end allows gas to flow from valve 51 into production tube 31.

Receptacle 36 also is adapted to allow control fluid to flow from control line 45 into valve 51. Receptacle 36, for example, has a short, cylindrical boss 37 extending radially away from its external wall in the vicinity of control fluid port 76 in gas injection valve 51. An incoming segment of control fluid line 45 and an outgoing segment of control fluid line 45 are connected to boss 37 and communicate with passages therein that allow control fluid to flow into the interior of receptacle 36. As described further below, pocket mandrel 32 also has a poppet valve 39 to control the flow of control fluid through boss 37, into receptacle 36, and ultimately into valve 51.

Flow of gas and control fluid into receptacle 36 is channeled by seals 89 on valve 51. More particularly; as seen best in FIG. 3, valve 51 has three annular seals 89 that are mounted on and extend around the outer circumference of housing 70. Annular seals 89 are elastomer seals having a hard backup ring in their midsection. Many such conventional seals are known and may be used. When valve 51 is installed, seals 89 engage and seal against the interior walls of receptacle 36.

Annular seals 89 divide the annular space between the exterior surface of valve housing 70 and the inner surface of receptacle 36 into two sealed annular spaces. The spaces allow fluid communication between control line 45, and between annulus 33 and gas injection valve 51. More specifically, upper seal 89*a* and middle seal 89*b* create a sealed space through which control fluid from control line 45 may flow into valve 51 via ports 76, thus opening and closing valve 51. Middle seal 89*bc* and bottom seal 89*c* create a sealed space through which gas from annulus 33 may flow into valve 51 via ports 77. Lower seal 89*c* isolates gas outlet ports 88 and fluid in production tube 31 from the sealed space proximate gas inlet ports 77, allowing gas to flow from valve 51 into production tube 31.

It will be appreciated that pocket mandrels 32 allow valves 51 to be installed easily and replaced if necessary through production tube 31. As noted above, when system 30 is first installed in casing 20, dummy valves 50 typically will be installed in receptacles 36 of mandrels 32. Dummy valves 50 may be solid metal blanks having more or less the same external configuration and dimensions as valves 51, Dummy valves 50 will be provided with external annular seals. Thus, when installed in receptacles 36, they will help prevent fluid and debris from entering receptacles 36 and control fluid line 45.

Gas injection valves 51 may be installed and retrieved with conventional tools deployed on a cable or "slickline" into production tube 31. A common wireline tool assembly may comprise a kickover tool, a jarring tool, and one or more roller tools for centering the tool assembly in production tube 31. Gas injection valve 51, for example, will be latched to an articulated arm on the kickover tool and folded into the kickover tool. The wireline tool assembly then will be deployed into production tube 31, typically under its own weight. Mandrel 32 will be provided with surfaces, slots, and the like which allow the kickover tool to be precisely located and oriented within mandrel 32. Once oriented, the kickover tool may be actuated to extend the articulated arm. The jarring tool then will be actuated to first bump valve 51 into receptacle 36 and then to release it from the kickover arm. Retrieval of valve 51 may be accomplished generally by reversing those steps.

It also will be appreciated that by using a single, common control line, such as control line 45, the novel gas lift systems as a practical matter do not significantly increase the overall radial footprint of production tube 31. Production tube 31, for example, still is an extremely compact assembly. Pocket mandrel 32 has a generally oval axial cross-section. Receptacle 36 is nested in one end of the oval, outside the drift 35 of production tube 31. Control fluid line 45 need only be relatively small, typically only ¼" in diameter. It also may be run along the minor width of packet mandrel 32. Thus, the design accommodates the valves and line required for operation of the lift system, allows for easy installation and replacement of valves, yet still allows for installation of relatively large production tubing.

Production tube check valve 55, like valves 51, preferably will be adapted for easy installation and replacement through production tube 31. For example, it preferably will be adapted for installation into constrictions in production tube 31. Typically, at least the lower portion of check valve 55 will have a generally cylindrical outer surface on which are provided one or more annular seals, allowing them to be inserted into their respective constrictions. Thus, check valve 55 may be installed and retrieved by slickline tools similar to those used to install valves 51.

It will be appreciated that during installation and replacement of valve 51 in receptacles 36 the fluid connection between valve 51 and control line 45 necessarily is temporarily disrupted. Any fluid escaping from control line 45 must be replaced before operations can continue. If control line 45 is filled with gas or hydraulic fluid, fluid can be replaced from the surface with some inconvenience, perhaps tolerable extra effort and time. If gas-over-hydraulic, however, the plug of hydraulic fluid at the bottom of control line 45 may easily flow out into production tube 31, but may require considerable time to refill. Thus, as noted, poppet valve 39 in mandrel 32 controls the flow of control fluid through boss 37 and into receptacle 36.

Figure 10:
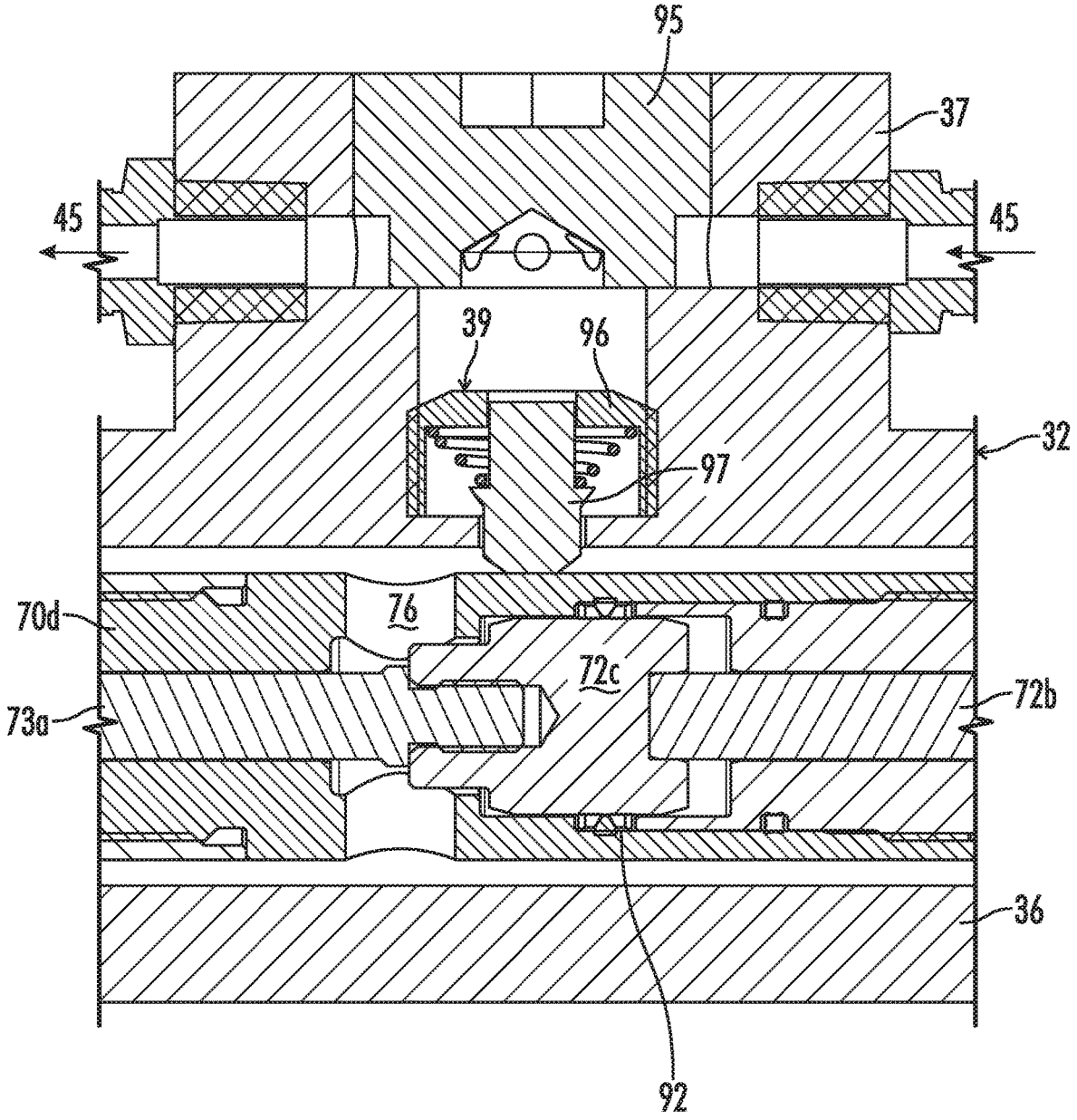
FIG. 10 is an enlarged view of a portion of FIG. 9 showing poppet valve 39.

More particularly, as seen best in FIG. 10, boss 37 is provided with a central bore extending axially along its length and through the wall of receptacle 36. An inlet bore and an outlet bore extend normally to the central bore of boss 37. The upper portion of the central bore has an enlarged inner diameter. A cap 95 is removably mounted therein, for example, by threaded connections. Cap 95 channels flow from the inlet bore to the outlet bore and into the lower portion of the central bore in boss 37.

More particularly, the lower portion of cap 95 has a reduced diameter, thus defining an annular flow path in the upper, enlarged-diameter portion of the central bore. Control fluid entering boss 37 through the inlet bore can flow around the lower, reduced-diameter portion of cap 95 and into the outlet bore. Cap 95 also is provided with ports leading from the outer surface of its reduced-diameter portion to its bottom surface. Control fluid thus can flow from the annular flow path downward into the lower portion of the central bore of boss 37.

The poppet mechanism comprises a spring retainer 96, a compression spring, and a poppet 97. Spring retainer 96 is mounted near the bottom of the central bore by, for example, threaded connections just above a reduced diameter portion of the central bore. Poppet 97 is a generally cylindrical body having a beveled rim in its midsection. Poppet 97 extends through, and fits loosely within the reduced-diameter portion of the central bore and through a centrally located opening in spring retainer 96.

The spring is mounted under compression between spring retainer 96 and the rim on poppet 97. Poppet 97 thus is biased downward and poppet valve 39 is normally closed. More particularly, when valve 51 is not installed in receptacle 36 (not shown), the rim of poppet 97 seats on a valve seat at the top of the reduced-diameter portion of the central bore. Poppet valve 39 is closed. The lower end of poppet 97 projects downward through and beyond the reduced-diameter portion of the central bore into the interior of receptacle 36.

Figure 8:
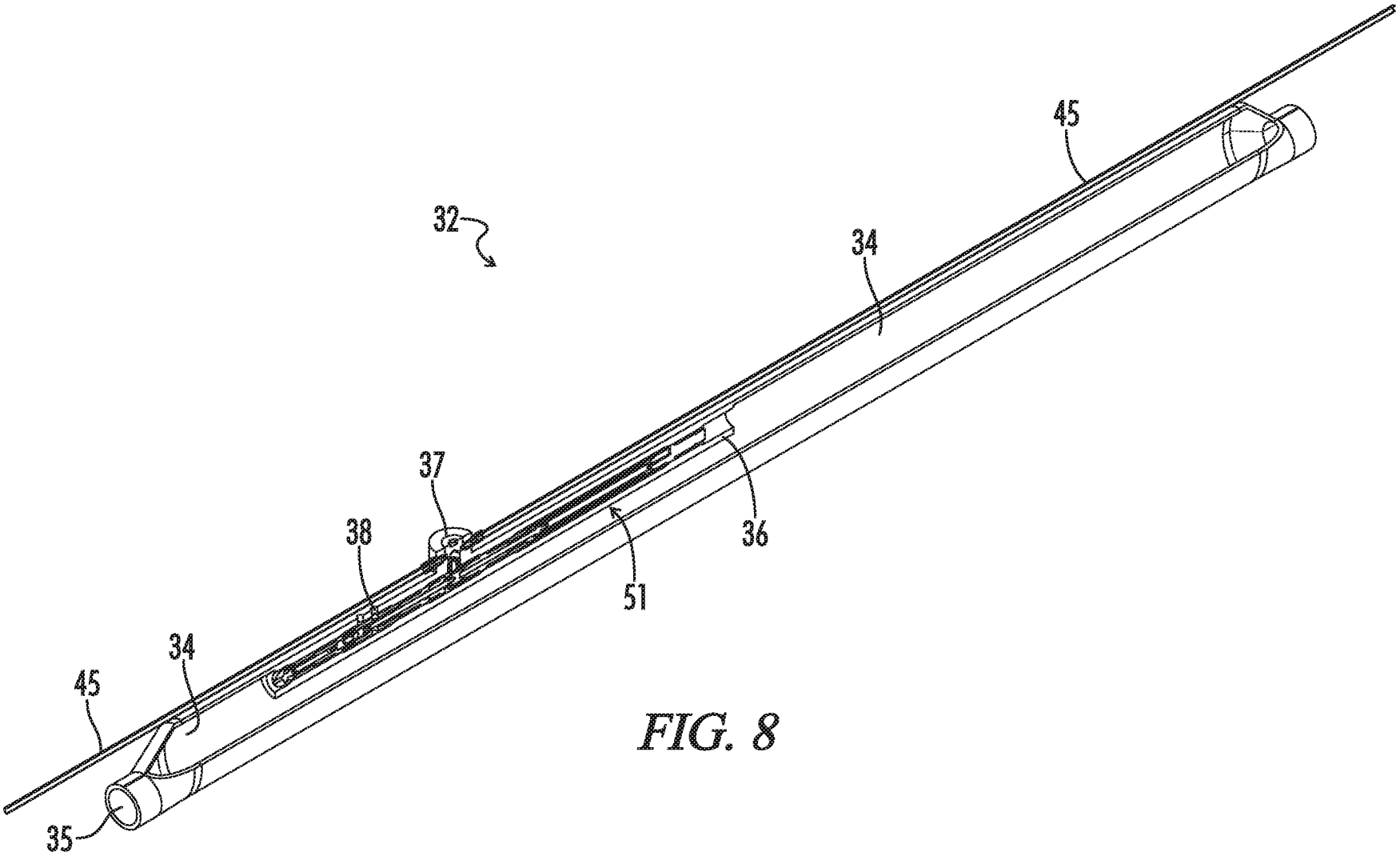
FIG. 8 is an isometric, quarter-sectional view of gas injection valve 51 installed in packet mandrel 32 shown in FIG. 7.
Figure 9:
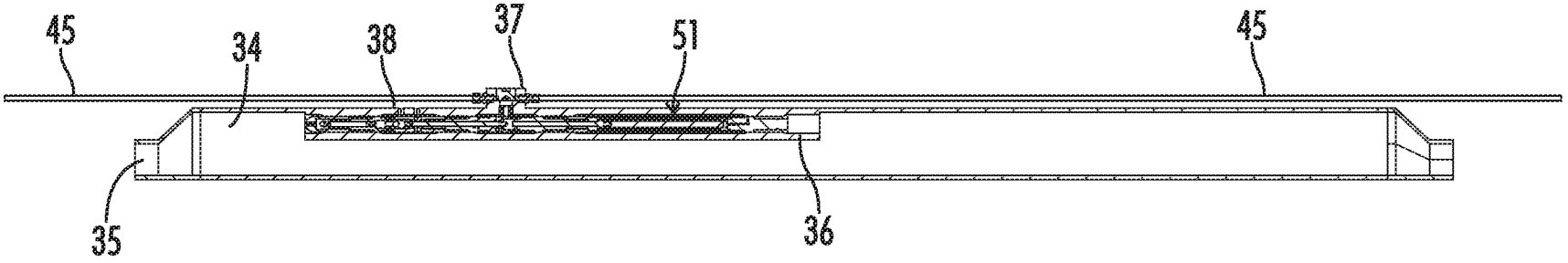
FIG. 9 is a longitudinal cross-sectional view of gas injection valve 51 installed in pocket mandrel 32.

When valve 51 is installed, as shown in FIGS. 8-9, poppet valve 39 will be placed in its open state. The lower end of poppet 97 has an annular bevel and provides a caroming surface. Poppet 97, therefore, will shift upward and ride along the outer surfaces of valve 51 as it is installed in receptacle 36. When it shifts upward, as seen best in FIG. 10, the rim on poppet 97 is lifted off the seat. Control fluid will be able to flow through the clearances between poppet 97 and the reduced diameter portion of the central bore. When valve 51 is removed, the spring will urge poppet 97 downward such that the rim again seats on the valve seat and poppet valve 39 is closed.

It will be appreciated, therefore, that the novel pocket mandrels, such as pocket mandrel 32, simplify the servicing and maintenance of the lift system. Poppet valve 39 ensures that negligible amounts of control fluid are lost as valves are installed and removed. If desired, however, conventional pocket mandrels may be used in embodiments of the novel gas lift systems. Pocket mandrels that may be suitable include the D and F series pocket mandrels from Dover Artificial Lift, The Woodlands, Tex. If conventional pocket mandrels are used, the control line preferably will incorporate a downhole, shut-off valve to minimize loss of fluid as valves are installed and removed. Suitable shut-off valves are disclosed in U.S. Pat. No. XXX.

Overview of Second Preferred Downhole Gas Control Valve

Figure 11A:
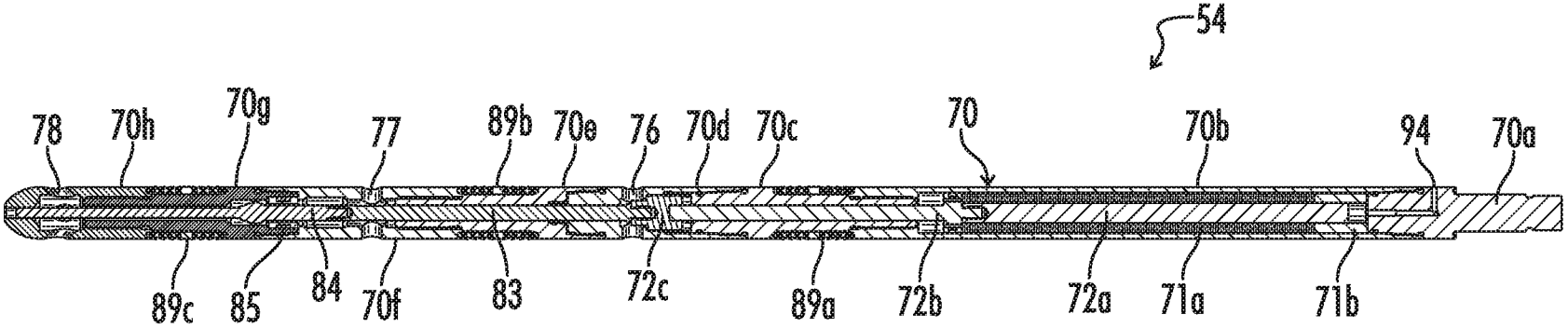
FIG. 11A is a longitudinal cross-sectional view of a second preferred embodiment 54 of the novel downhole gas control valves of the subject invention, showing downhole control valve 54 in its normal, open state.
Figure 11B:
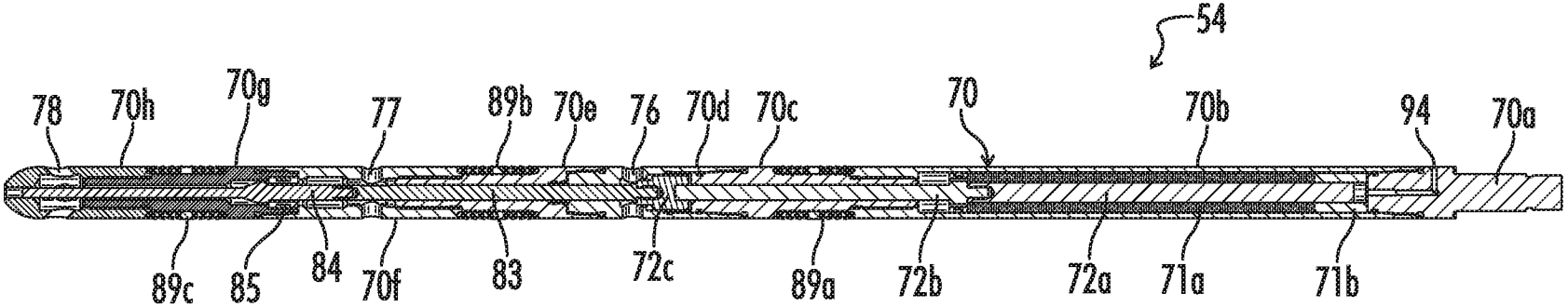
FIG. 11B is a longitudinal cross-sectional view of downhole control valve 54 in its actuated, closed state.

A second preferred embodiment 54 of the downhole gas control valves of the subject invention is shown in FIG. 11. As shown therein, valve 54 is similar in many respects to novel valve 51 except that it is a normally-open valve. Valve 54 generally comprises housing 70, washer stack 71, piston assembly 72, a valve stem 83, a valve body 84, and a seat 85. Like gas injection valve 51, valve 54 may be actuated by sending pressure signals through a control line (not shown) to compress washer stack 71. Valve 54 is shut, not opened as washer stack 71 is compressed.

More particularly, a downward-facing valve seat 85 is mounted in the upper portion of housing sub 70*g*. Valve body 84 is an elongated, cylindrical component having a radially enlarged portion in its upper midsection. The upper portion of valve body 84 extends from valve stem 83 through valve seat 85 such that the radially-enlarged portion is situated below valve seat 85. Valve body 84 may extend, as shown, into an axial passage at the end of housing sub 70*h*. That arrangement may help stabilize valve body 84 as it reciprocates within housing 70. Valve body 84 preferably is removably attached to valve stem 83 by, for example, threaded connections so that it may be replaced easily if worn.

Valve 54 is actuated in the same manner as gas injection valve 51, except that it is normally open. Washer stack 71 generates a biasing force that is transmitted through piston assembly 72 and stem 83 to hold valve body 84 off valve seat 85. Control fluid may be introduced via a control line or other conduit into the actuation chamber provided in housing sub 70*d*. Increasing pressure will compress washer stack 71, pulling valve body 84 upward. The radially-enlarged enlarged portion of valve body 84 will seat on valve seat 85, shutting the gas flow path through valve 54. When pressure is relieved in the actuation chamber, washer stack 71 will urge valve body 84 downward, pushing the radially-enlarged diameter portion off seat 85 and returning valve 54 to its normally-open state.

If desired, valve 54 may be used as injection valves in a gas lift system such as lift system 30. It will be appreciated, however, that each valve 54 in the system would have be tuned such that progressively greater pressure is needed to shut valves 54 as the depth of the stations increase. Moreover, in the event of a pressure loss in the control line, the normally-open valves 54 will allow liquid to fill the annulus. Thus, valves 51 are greatly preferred for use as a gas injection valve in lift systems.

Valve 54, however, is ideally suited for other downhole gas control operations, especially when they will be installed in deeper wells. Valve 54, for example, may be used as a gas vent valve in gas pumps, such as those disclosed in in U.S. Pat. No. XXX. Valve 51 may be used as a gas supply valve in such gas pumps. In that application, gas outlet ports 78 in valve 54 will serve as gas inlets, while gas inlet ports 77 will serve as gas outlets. It also will be appreciated that valve 54 is provided with three external, annular seals 89. Thus, like valve 51 it may be easily and retrievably mounted in pocket mandrels, such as receptacle 36 of novel pocket mandrel 32.

Overview of Third Preferred Downhole Gas Control Valve

As discussed above, embodiments such as novel gas injection valve 51 that have a stack of Belleville washers have significant advantages over injection valves where the resilient biasing element is provided by pressure-responsive bellows. Nevertheless, embodiments of the novel lift systems can incorporate conventional and other bellows-type valves. Such embodiments still provide the benefits associated with controlling the array of unloading valves and operating valve through a single, common control line.

Figure 12:
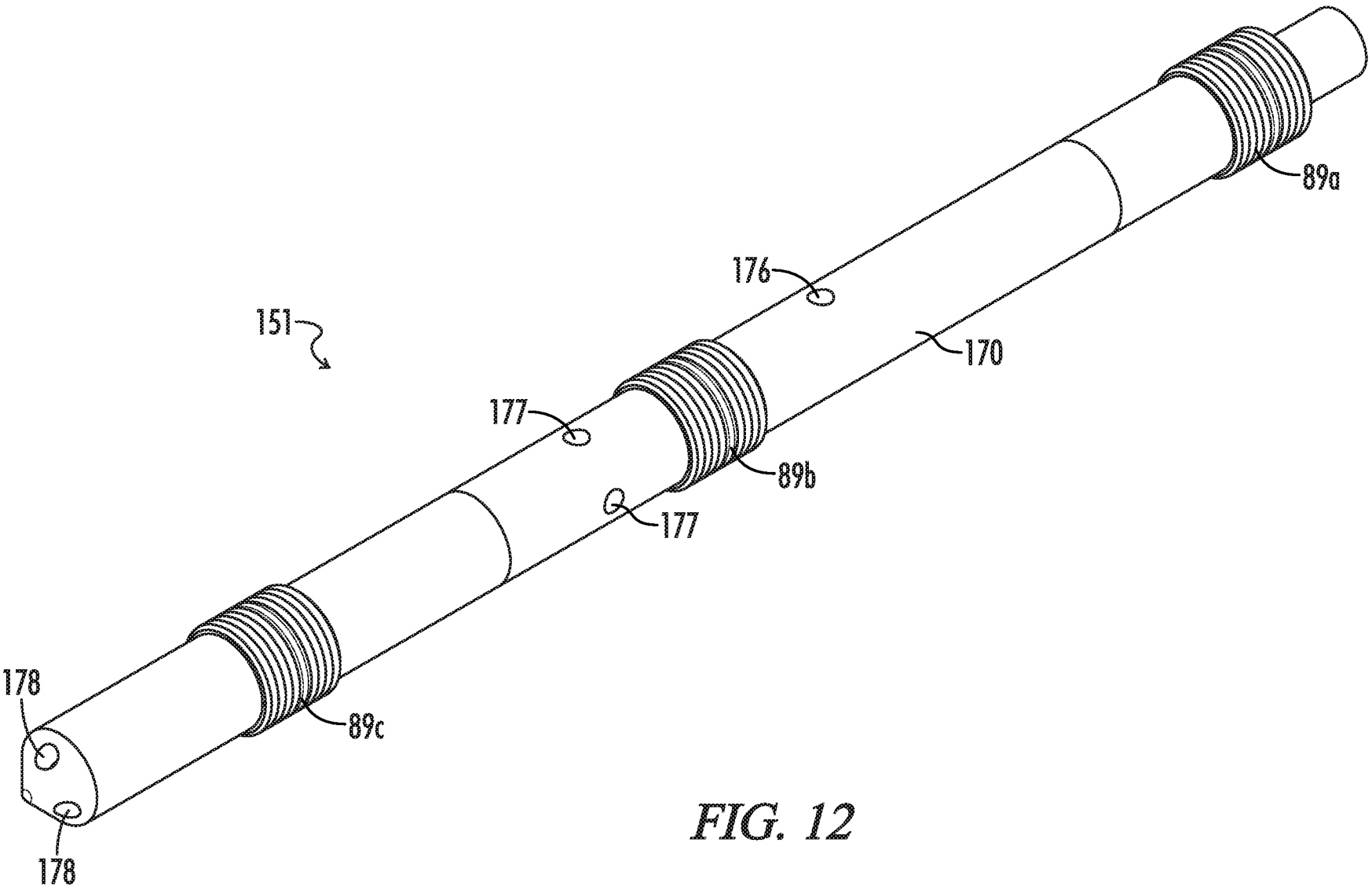
FIG. 12 is an isometric view of a third preferred embodiment 151 of the novel downhole gas control valves of the subject invention which may be used in novel production system 30 as a gas injection valve, which valve 151 is in its normal, closed state.
Figure 13:
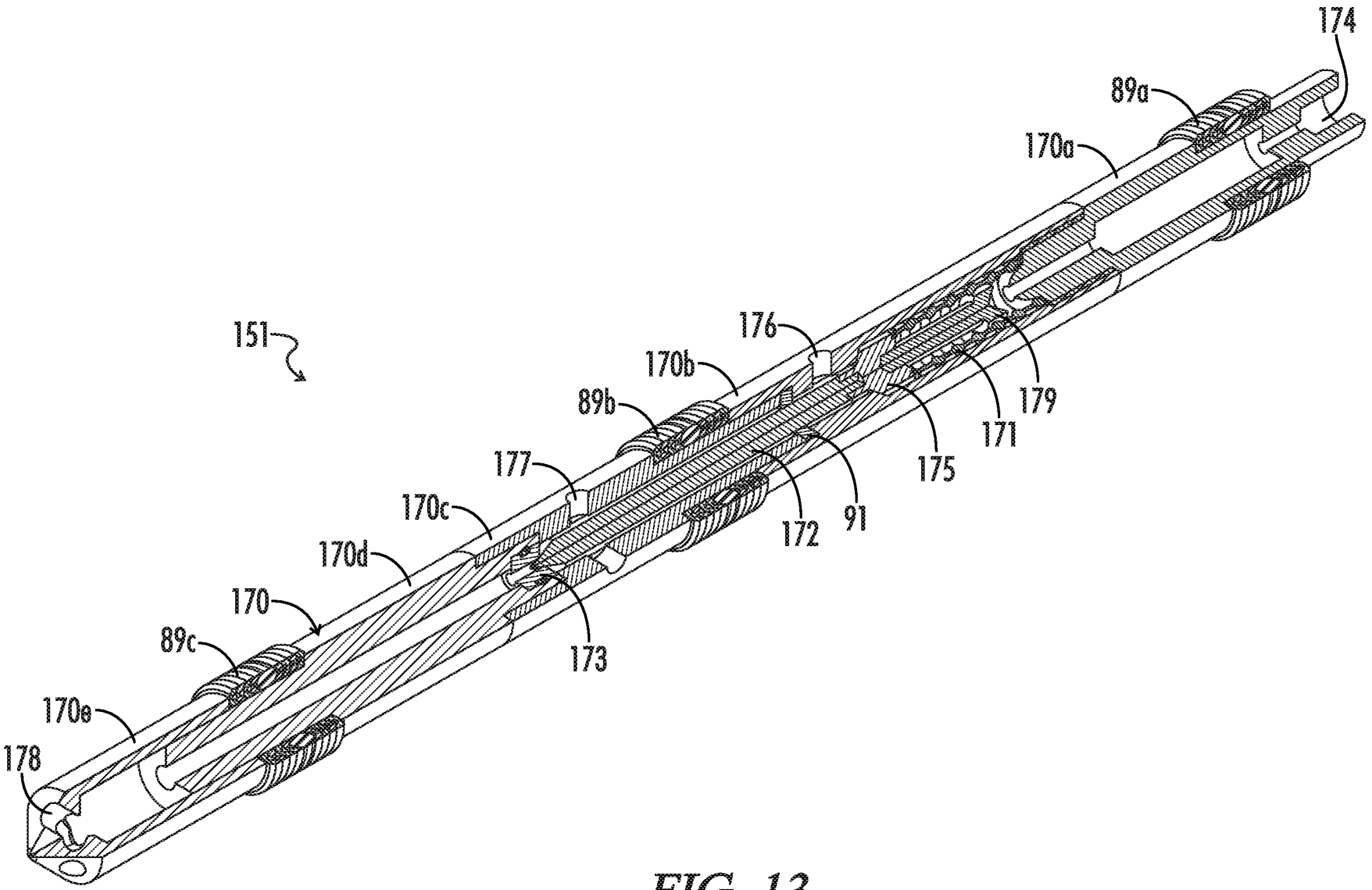
FIG. 13 is an isometric, quarter-sectional view of gas injection valve 151 shown in FIG. 12 showing gas injection valve 151 in its normal, closed state.

Thus, a third preferred embodiment 151 of preferred downhole gas control valves is shown in FIGS. 12-14. Valve 151 may be used as a gas injection valve in gas lift systems, such as lift system 30. As may be seen in the figures, gas injection valve 151 generally comprises a housing 170, a bellows 171, a valve stem 172, and a valve seat 173. Valve housing 170 has a generally cylindrical shape and is assembled from five subs 170*a* to 170*e*, for example, by threaded connections. Upper housing sub 170*a* defines various chambers. The chambers may be filled with compressed gas, such as nitrogen gas, and sealed, for example, by a valved cap (not shown) threaded into a nitrogen port 174.

Bellows 171 is mounted to the lower end of first or upper housing sub 170*a*. It extends downward through a control fluid actuating chamber defined primarily by second housing sub 170*b*. The lower end of bellows 171 is closed by a bellows cap 175. The open upper end of bellows 171 is mounted around a passage in upper housing sub 170*a*. Thus, bellows 171 communicates with and is pressurized by gas within the sealed chamber in housing sub 170*a*. Preferably, bellows 171 will be partially filled with a silicon oil or the like to dampen the effects of sudden changes of pressure on bellows 171.

Valve stem 172 extends into the lower portion of the control fluid actuating chamber defined by housing sub 170*b* and is attached at its upper end to bellows 171 by bellows cap 175. The lower portion of valve stem 172 extends through the upper portion of a gas supply chamber defined primarily by housing subs 170*c*, 170*d*, and 170*e*. Seals 91, such as an annular elastomer packing, are provided around valve stem 172 to isolate the actuating chamber from the gas supply chamber. The tip of valve stem 172 provides a downward-facing valve body that seats on upward-facing valve seat 173. Valve seat 173 preferably, as shown, is provided on an insert which is carried, for example, within housing sub 170*d* so that it may be replaced when worn.

Figure 14A:
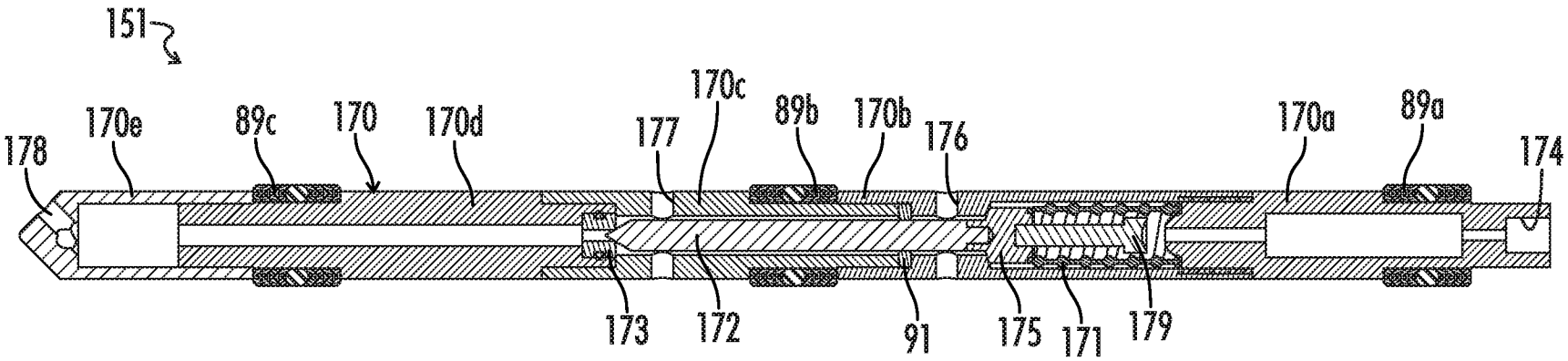
FIG. 14A is a lateral cross-sectional view of gas injection valve 151 in its normal, closed state.

The dome pressure of valve 151, that is, the pressure within the sealed chamber defined by housing sub 170*a* will be adjusted according to the fluid pressure in control line 45. More specifically, it will be set somewhat higher than the pressure created by the fluid column in control line 45, but somewhat lower than the pressure signal that will be generated at the surface. Thus, gas injection valve 151 may be actuated by increasing and decreasing the fluid pressure in the actuating chamber around bellows 171. When the fluid pressure is relatively low, bellows 171 is inflated. Valve stem 172 is extended such that its tip seats on valve seat 173 as shown in FIGS. 13 and 14A. Flow through valve seat 173 and the gas supply chamber within housing subs 170*c/d/e* is shut off.

Figure 14B:
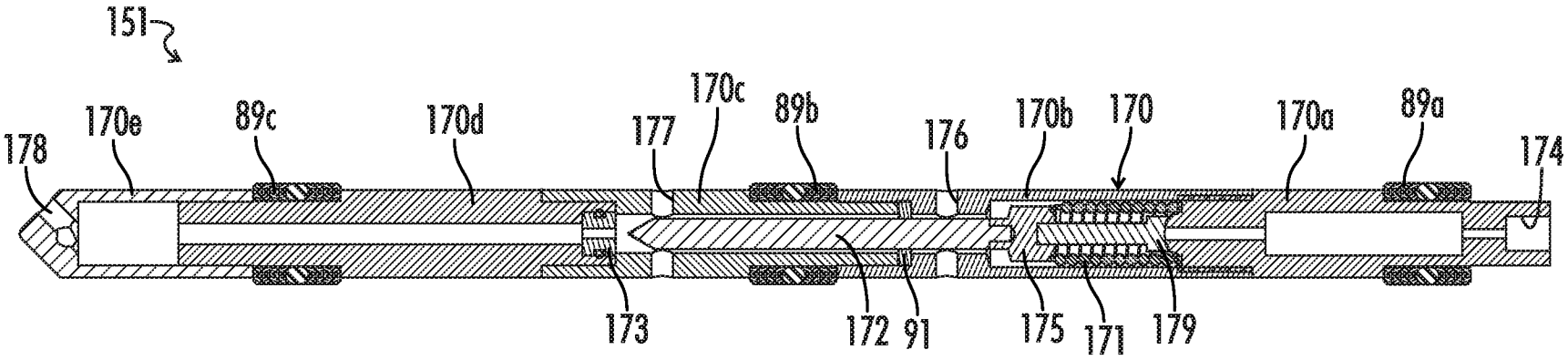
FIG. 14B is a lateral cross-sectional view of gas injection valve 151 in its actuated, open state.

Valve 151 may be opened, however, by sending a pressure signal through control line 45 (not shown). Control fluid will be introduced into valve 151 via control fluid ports 176 provided in housing sub 170*b*. As pressure increases within the actuating chamber, bellows 171 will begin to collapse. As bellows 171 collapses, it pulls valve stem 172 upward and off valve seat 173 as shown in FIG. 14B. Valve stem 172 also may be spring loaded to assist in pulling valve stem 172 off valve seat 173. A stop rod 179 connected to valve stem 172 via bellows cap 175 limits the collapse of bellows 171 to help avoid damage to bellows 171 if excessive pressure is introduced into valve 151. In any event, gas can flow into valve 151 through inlet ports 177, through valve seat 173, and out valve 151 through outlet ports 178. Valve 151 may be shut again by bleeding pressure out of control line 45. Since they are filled with compressed nitrogen, bellows 171 will expand again and push stem 172 back onto valve seat 173.

Overview of Fourth Preferred Gas Injection Valve

Figure 15:
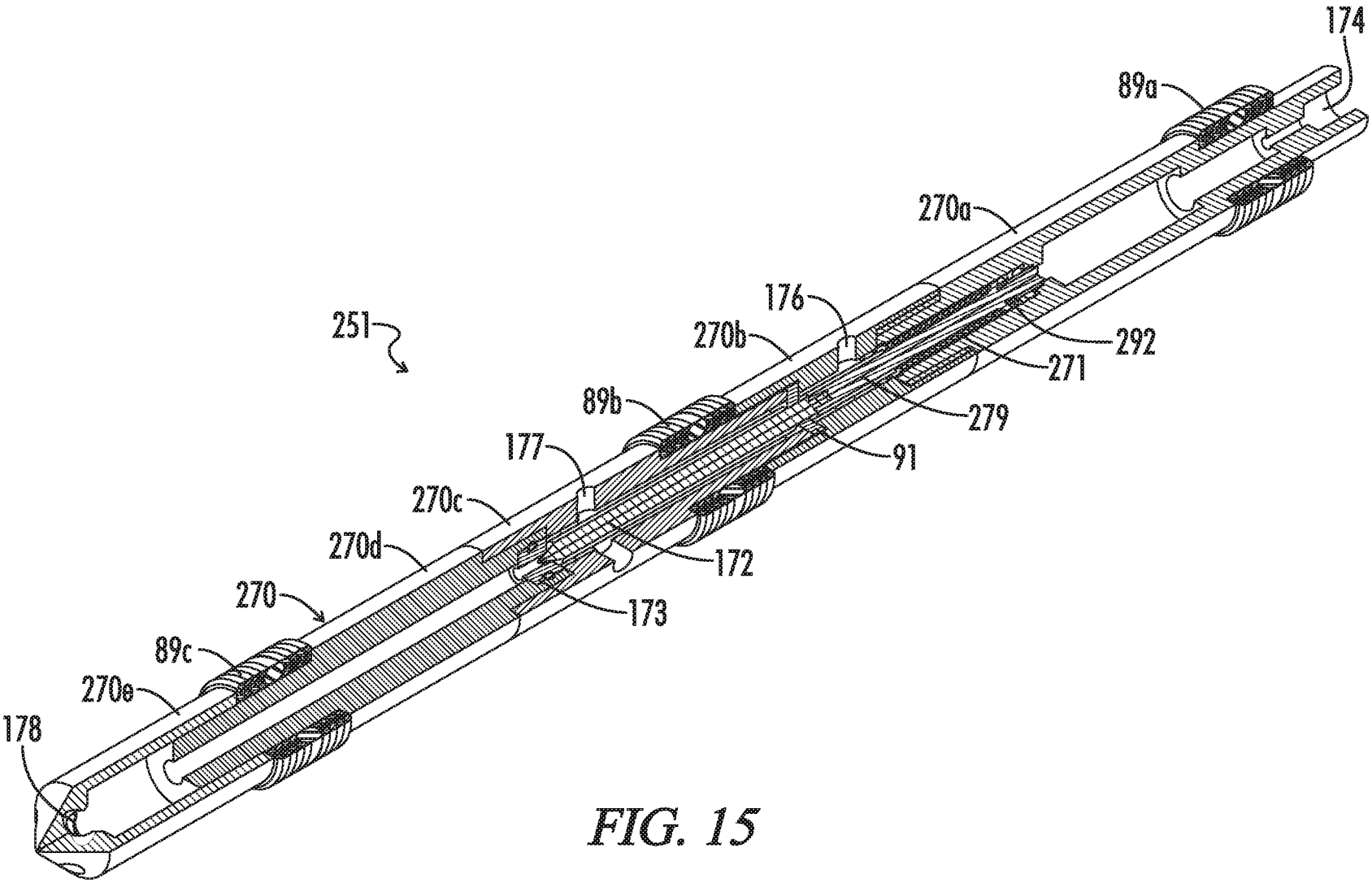
FIG. 15 is an isometric, quarter-sectional view of a fourth preferred embodiment 251 of the novel downhole gas control valves of the subject invention which may be used in novel production system 30 as a gas injection valve, which valve 251 is in its normal, closed state.

A fourth preferred embodiment 251 of preferred downhole gas control valves is shown in FIGS. 15-16. Valve 251 also may be used as a gas injection valve in gas lift systems, such as lift system 30. As shown in the figures, gas injection valve 251 generally comprises a housing 270, a bellows 271, a valve stem 172, a stem extension 279, and a valve seat 173. Gas injection valve 251 is similar to gas injection valve 151 except that bellows 271 is inverted as compared to bellows 171. Valve housing 270, like valve housing 170, is assembled from five subs 270*a* to 270*e*, but subs 270*a* and 270*b* have been modified to accommodate bellows 271.

Bellows 271 is mounted to the lower end of housing sub 270*a*. Housing sub 270*a* defines various sealed passages and chambers including a lower chamber. Bellows 271 extends upward into the lower sealed chamber of housing sub 270*a*. The upper end of bellows 271 is closed by an upper portion of stem extension 279. The open lower end of bellows 271 is mounted within the lower end of the lower chamber of housing sub 270*a*. The interior of bellows 271, therefore, can communicate with a control fluid actuating chamber defined primarily by housing sub 270*b*.

The lower sealed chamber of housing sub 270*a* may be filled with compressed gas introduced, for example, through a valved cap (not shown) threaded into port 174 defined by housing sub 270*a*. Preferably, however, the lower chamber will be filled with a silicon oil or other liquid to dampen the effects of sudden changes of pressure on bellows 271. Compressed gas may be provided in the upper chambers and passages within upper housing sub 270*a*.

The lower tip of valve stem 172 provides a downward-facing valve body that seats on upward-facing valve seat 173. The upper end of valve stem 172 extends into the actuating chamber defined by housing sub 270*b* and is attached to the lower end of stem extension 279. Valve stem extension 279 extends through the interior of bellows 271. Valve stem 172 is thus operably connected to bellows 271. It also will be noted that valve stem extension 279 extends past the point where it is affixed to bellows 271 and into a passage defined in upper housing sub 270*a*. The passage thus serves to guide the reciprocating motion of valve stem 172 and extension 279.

Figure 16A:
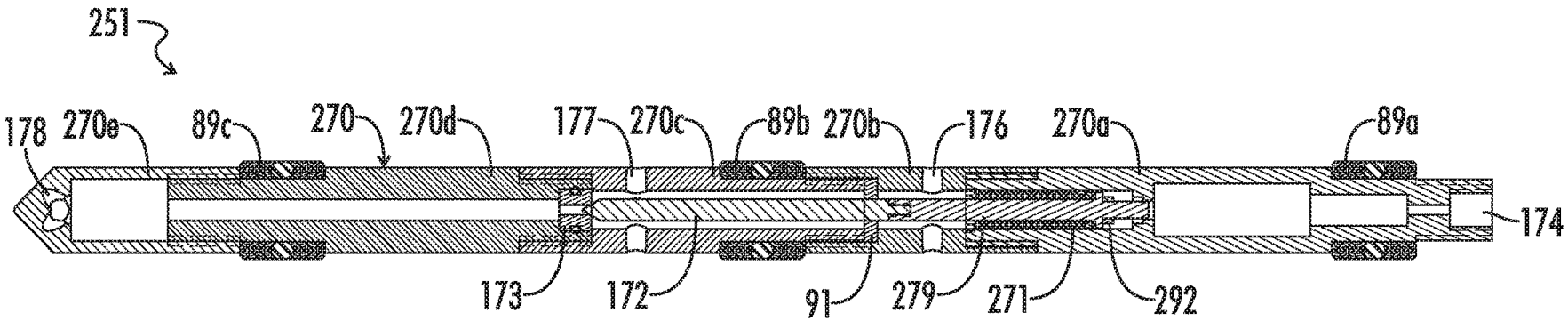
FIG. 16A is a lateral cross-sectional view of gas injection valve 251 shown in FIG. 15 in its normal, closed state.

Like gas injection valve 151, gas injection valve 251 may be actuated by increasing and decreasing the fluid pressure in the actuating chamber. When the fluid pressure is relatively low, bellows 271 is deflated by the pressure present in the lower chamber of housing sub 270*a*. Valve stem 172 is extended such that its tip seats on valve seat 173 as shown in FIGS. 15 and 16A. Flow through valve seat 173 and the gas supply chamber within housing subs 270*c/d/e* is shut off.

Figure 16B:
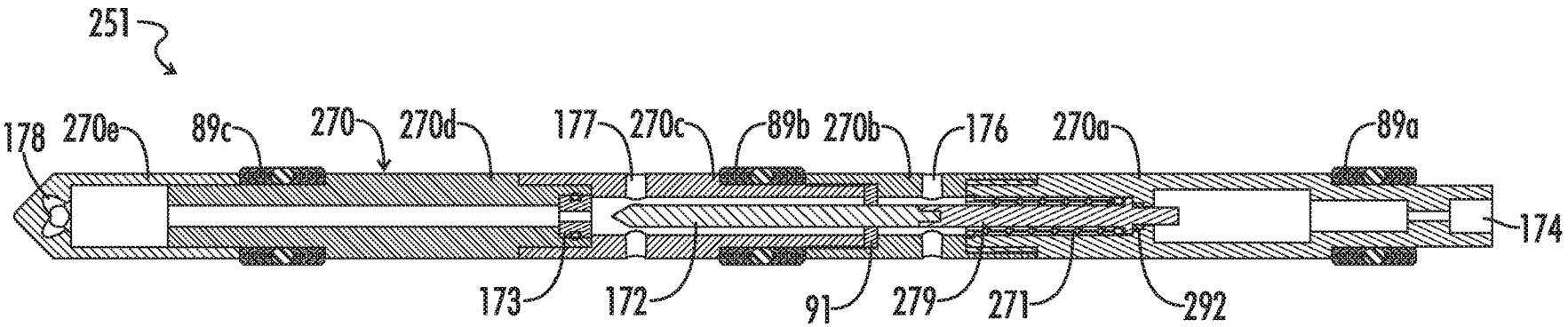
FIG. 16B is a lateral cross-sectional view of gas injection valve 251 in its actuated, open state.

Valve 251 may be opened, however, by sending a pressure signal through control line 45 (not shown). Control fluid will be introduced into valve 251 via control fluid ports 176 provided in housing sub 270*b*. As pressure increases within the actuating chamber, bellows 271 will begin to expand. As bellows 271 expands, it pulls valve stem 172 upward and off valve seat 173 as shown in FIG. 16B. Valve stem 172 also may be spring-loaded to assist in pulling valve stem 172 off valve seat 173.

In any event, gas can flow into valve 251 through inlet ports 177, through valve seat 173, and out valve 251 through outlet ports 178. Valve 251 may be shut again by bleeding pressure out of control line 45. Since the lower chamber in housing sub 270*a* is pressurized by compressed nitrogen, bellows 271 will collapse again and push stem 172 back onto valve seat 173.

Pressure in control line 45 and in the actuating chamber of valve 251 is communicated to the interior of bellows 271. If that pressure is too high, it can essentially blow out bellows 271. Thus, the lower chamber within upper sub 270*a* preferably is filled with a liquid, such as silicon oil, and stem extension 279 preferably is provided with a bellows seal, such as bellows seal 292. Bellows seal 292 is carried around the upper end of stem extension 279. Once bellows 271 expands sufficiently such that valve stem 172 is pulled away from valve seat 173, bellows seal 292 will be carried up and will seal within the passage leading from the lower chamber of housing sub 270*a*. Flow from the lower chamber is shut off, but the lower chamber remains filled with an essentially incompressible fluid. Thus, further expansion of bellows 271 is substantially foreclosed.

Overview of Fifth Preferred Gas Injection Valve

Figure 17:
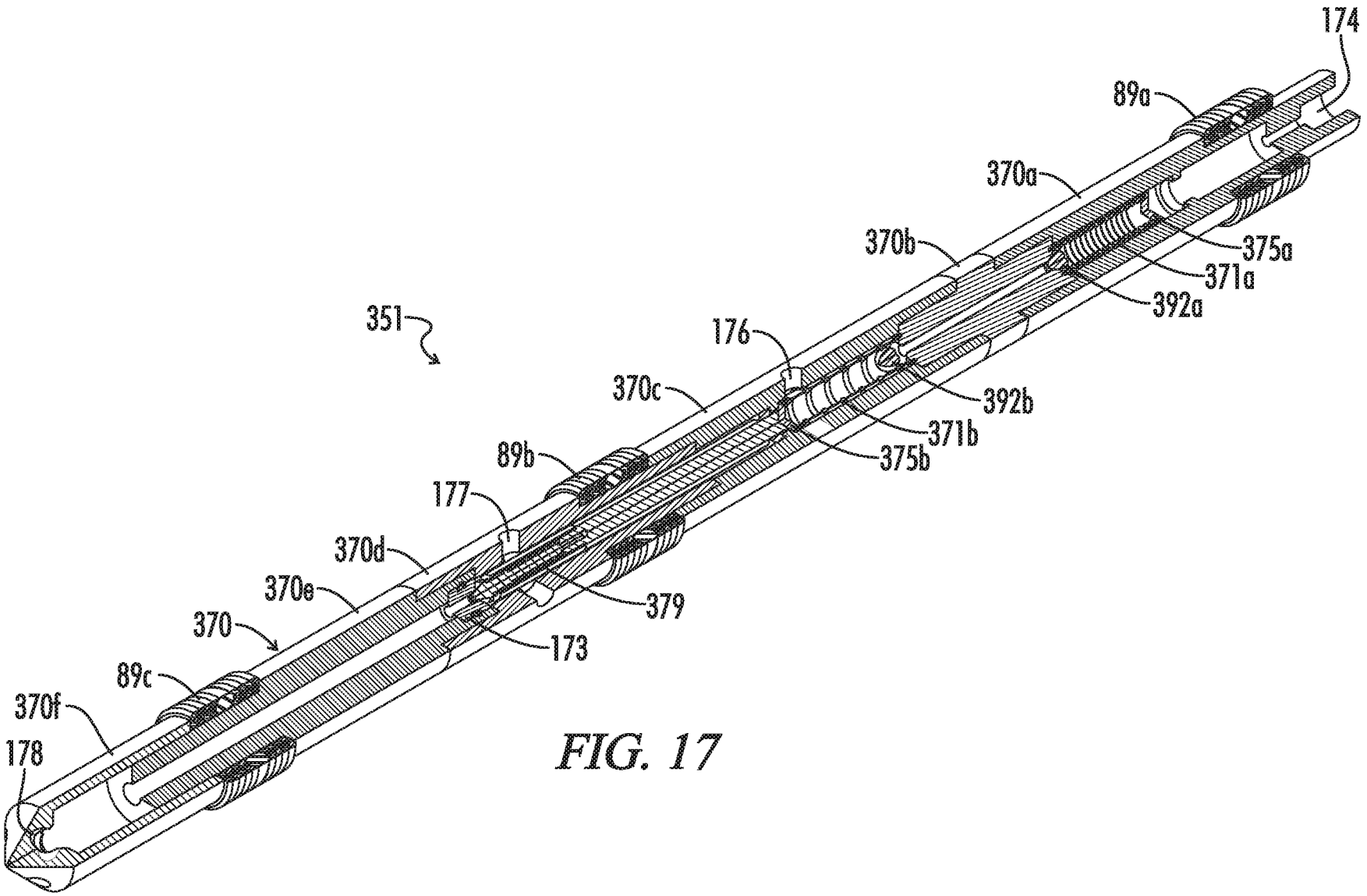
FIG. 17 is an isometric, quarter-sectional view of a fifth preferred embodiment 351 of the novel downhole gas control valves of the subject invention which may be used in novel production system 30 as a gas injection valve, which valve 351 is in its normal, closed state.

A fourth preferred embodiment 351 of preferred gas injection valves is shown in FIGS. 17-18. Valve 351 may be used as a gas injection valve in gas lift systems, such as lift system 30. As shown in the figures, gas injection valve 351 generally comprises a housing 370, a pair of cooperating bellows 371*a* and 371*b*, a valve stem 372, a spring-loaded stem tip 379, and a valve seat 173. Injection valve 351 is similar to gas injection valves 151 and 251 except that it utilizes a pair of cooperating bellows 371 instead of single bellows 171 and 271. Valve housing 370 is assembled from six subs 370*a* to 370*f*, for example, by threaded connections.

The lower end of upper bellows 371*a* is mounted to the upper end of housing sub 370*b* around a passage extending therethrough. The upper end of bellows 371*a* is closed by a bellows cap 375*a*. Bellows 371*a* extends upward into a lower sealed chamber defined primarily by housing sub 370*a*, The lower chamber of housing sub 370*a* may be filled with compressed gas introduced, for example, through a valved cap (not shown) threaded into port 174 defined by housing sub 370*a*. Preferably, however, the lower chamber will be filled with a silicon oil or other liquid to dampen the effects of sudden changes of pressure on bellows 371*a*. Compressed gas may be provided in the upper chambers and passages within upper housing sub 370*a*.

The upper end of lower bellows 371*b* is mounted to the lower end of housing sub 370*b* around the passage extending therethrough. The lower end of bellows 371*b* is closed by a bellows cap 375*b*. Bellows 371*b* extends downward into the control fluid actuating chamber defined by housing sub 370*c*. Both bellows 371 are filed with hydraulic fluid which can flow back and forth between bellows 371*a* and 371*b* through the passage in housing sub 370*b*.

Spring-loaded tip 379 of valve stem 372 provides a downward-facing valve body that seats on upward-facing valve seat 173. The upper end of valve stem 172 extends into the actuating chamber defined by housing sub 370*c* and is attached to the bellows cap 375*b* of lower bellows 371*b*.

Figure 18A:
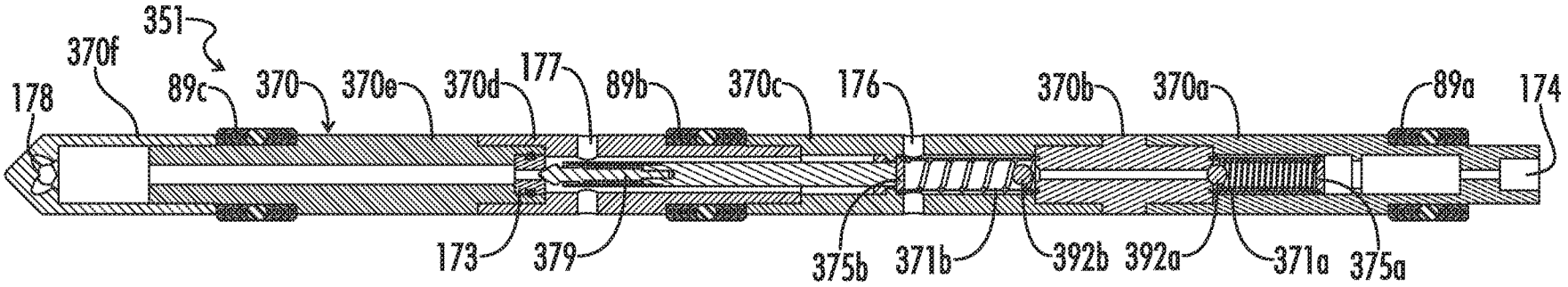
FIG. 18A is a lateral cross-sectional view of gas injection valve 351 shown in FIG. 17 in its normal, closed state.

Thus, gas injection valve 351 may be actuated by increasing and decreasing the fluid pressure in the actuating chamber. When the fluid pressure is relatively low, the pressure present in the lower chamber of housing sub 370*a* pushes fluid from upper bellows 371*a*, through the passage in housing sub 370*b*, and into lower bellows 371*b*. Upper bellows 371*a* collapses, lower bellows 371*b* expands, and valve stem 372 extends such that its tip 379 seats on valve seat 173 as shown in FIGS. 17 and 18A. Flow through valve seat 173 and the gas supply chamber within housing subs 370*c/d/e/f* is shut off.

Figure 18B:
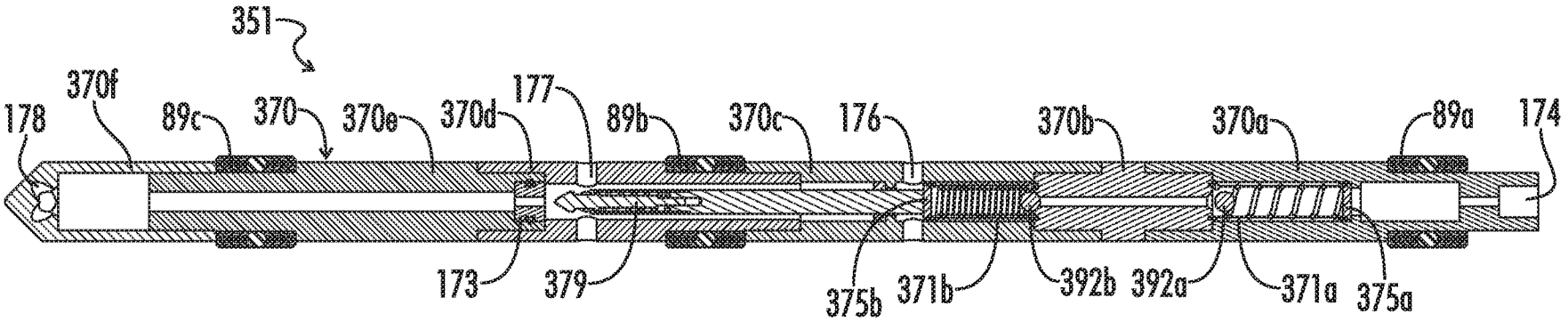
FIG. 18B is a lateral cross-sectional view of gas injection valve 351 in its actuated, open state.

Valve 351 may be opened, however, by sending a pressure signal through control line 45 (not shown). Control fluid will be introduced into valve 351 via control fluid ports 176 provided in housing sub 370*c*. As pressure increases within the actuating chamber, fluid is pushed from lower bellows 371*b*, through the passage in housing sub 370*b*, and into upper bellows 371*a*. Lower bellows 371*b* collapses, upper bellows 371*a* expands, and valve stem 372 begins to travel upward. The spring is under compression when tip 379 is seated on valve seat 173. Thus, the spring will urge valve stem 372 upward and assist in pulling stem tip 379 off valve seat 173 as shown in FIG. 18B.

In any event, gas can flow into valve 351 through inlet ports 177, through valve seat 173, and out valve 351 through outlet ports 178. Valve 351 may be shut again by bleeding pressure out of control line 45. Since the lower chamber in housing sub 370*a* is pressurized by compressed nitrogen, upper bellows 371*a* will collapse again, lower bellows 371*b* will expand again, and stem tip 379 will be urged again against valve seat 173.

Preferably, as shown, check valves 392*a* and 392*b* are provided, respectively, within upper bellows 371*a* and lower bellows 371*b* to help avoid damage to bellows 371. Check valves 392 will shut off flow through the passage in housing sub 370*b* once a bellows 371 has been fully collapsed. Once flow through the passage is shut, the essentially incompressible fluid within the collapsed bellows 371 prevents it from being imploded. It also prevents fluid from blowing up the expanded bellows 371.

Gas lift system 30 and other embodiments have been described as installed in a casing and, more specifically, a production casing used to fracture a well in various zones along the wellbore. A "casing," however, can have a fairly specific meaning within the industry, as do "liner" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. In essence, a "liner" is a "casing" that does not extend from the surface. "Tubing" refers to a smaller tubular conduit, usually less than 4.5" in diameter. The novel systems and pumps, however, are not limited in their application to casing as that term may be understood in its narrow sense. They may be used to advantage in liners, casings, and perhaps even in smaller conduits or "tubulars" as are commonly employed in oil and gas wells. A reference to casings shall be understood as a reference to all such tubulars.

While this invention has been disclosed and discussed primarily in terms of specific embodiments thereof, it is not intended to be limited thereto. Other modifications and embodiments will be apparent to the worker in the art.

What is claimed is:

1. A downhole valve for controlling flow of gas through a gas lift system for producing liquids from an oil and gas well, said downhole gas control valve comprising:

(a) a valve housing having a gas inlet, a gas outlet, a control fluid inlet, and a pressure equalization port;

(b) a gas flowpath from said gas inlet to said gas outlet;

(c) a piston mounted for reciprocating movement within said housing away from and towards a normal position;

(d) a valve seat in said gas flowpath;

(e) a valve body coupled to said piston and adapted to selectively seat on said valve seat to open and shut said gas flowpath;

(f) an actuating chamber on a first side of said piston; said actuating chamber communicating with said control fluid inlet and being isolated from said gas flowpath;

(g) a washer chamber on a second side of said piston, said washer chamber communicating with said pressure equalization port whereby fluid leaking past said piston into said washer chamber can flow out of said valve; and (h) a stack of Belleville washers arranged in said washer chamber, said washer stack being under compression to bias said piston in said normal position and resist movement of said piston away from said normal position;

(i) wherein said piston is responsive to fluid pressure in said actuating chamber and said washer stack such that said valve body may be selectively seated on said valve seat by sequentially increasing and decreasing pressure in said actuating chamber relative to the biasing force of said washer stack.

2. The downhole gas control valve of claim 1, wherein said valve housing has a generally elongated, cylindrical shape and said piston and said valve body are aligned and reciprocate along the primary axis of said valve housing.

3. The downhole gas control valve of claim 1, wherein said valve body is coupled to said piston by a valve stem.

4. The downhole gas control valve of claim 3, wherein said valve stem extends between said piston and said valve body along the path of said piston reciprocating movement.

5. The downhole gas control valve of claim 1, wherein (a) said valve body is seated on said valve seat and said valve is shut when said piston is in its said normal position; and (b) said valve is adapted to open when fluid pressure in said actuating chamber is increased above an actuation pressure exceeding the biasing force of said washer stack and to close when fluid pressure in said actuating chamber is decreased below said actuation pressure.

6. The downhole gas control valve of claim 1, wherein (a) said valve body is not seated on said valve seat and said valve is open when said piston is in its said normal position; and (b) said valve is adapted to close when fluid pressure in said actuating chamber is increased above an actuation pressure exceeding the biasing force of said washer stack and to open when fluid pressure in said actuating chamber is decreased below said actuation pressure.

7. A gas lift system for producing liquids from a well; said gas lift system comprising:

(a) production tubing adapted to convey fluid from said well to the surface;

(b) a plurality of gas injection valves of claim 1 installed on said production tubing and adapted to control the flow of gas between an annulus surrounding said production tubing and said production tubing; and (c) a single fluid control line communicating with said control fluid inlet of said gas injection valves.

8. A method of producing liquids from a well, said method comprising operating the gas lift system of claim 7.

9. A gas pump system for producing liquids from a well comprising the downhole gas control valve of claim 1.

10. A method of producing liquids from a well, said method comprising operating the gas pump system of claim 9.

11. The downhole gas control valve of claim 1, wherein said valve comprises a check valve in said equalization port adapted to check fluid flow into said washer chamber.

12. The downhole gas control valve of claim 11, wherein said valve comprises a piston rod coupled to said piston, said piston rod having a port allowing flow of fluid from a first portion of said washer chamber proximate said piston to a second portion of said washer chamber distant from said piston.

* * * * *